US007434561B2

(12) United States Patent
Suzuki et al.

(10) Patent No.: US 7,434,561 B2
(45) Date of Patent: Oct. 14, 2008

(54) ENGINE

(75) Inventors: Kozo Suzuki, Kobe (JP); Hisatoyo Arima, Himeji (JP); Toshiyuki Tsubone, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/651,942

(22) Filed: Jan. 9, 2007

(65) Prior Publication Data

US 2007/0157900 A1 Jul. 12, 2007

(30) Foreign Application Priority Data

Jan. 10, 2006 (JP) ..... 2006-002402

(51) Int. Cl.
*F01M 1/02* (2006.01)
*F01L 1/34* (2006.01)

(52) U.S. Cl. ..... 123/196 R; 123/196 AB; 123/90.15

(58) Field of Classification Search ..... 123/196 R, 123/196 AB, 41.33, 90.15–90.18
See application file for complete search history.

(56) References Cited

U.S. PATENT DOCUMENTS 3,777,729 A * 12/1973 Cote ..... 123/386
4,106,446 A * 8/1978 Yamada et al. ..... 123/90.13
4,122,818 A * 10/1978 Hattori ..... 123/196 AB
5,353,755 A * 10/1994 Matsuo et al. ..... 123/90.17
5,503,117 A * 4/1996 Saito ..... 123/41.44
5,718,196 A * 2/1998 Uchiyama et al. ..... 123/195 C
6,182,625 B1 * 2/2001 Ozeki et al. ..... 123/196 R
6,260,533 B1 * 7/2001 Tanaka ..... 123/196 R
6,532,930 B2 * 3/2003 Kobayashi et al. ..... 123/196 R
6,662,771 B2 * 12/2003 Kobayashi ..... 123/90.33
2002/0035981 A1 * 3/2002 Kobayashi ..... 123/196 M
2002/0179170 A1 * 12/2002 Guippe et al. ..... 138/141
2004/0069260 A1 * 4/2004 Fujikubo ..... 123/90.31

FOREIGN PATENT DOCUMENTS

JP 07-127661 5/1995

* cited by examiner

*Primary Examiner*—Noah Kamen
(74) *Attorney, Agent, or Firm*—Alleman Hall McCoy Russell & Tuttle

(57) ABSTRACT

An engine including an oil passage through which oil output from an oil pump flows, an oil cooler mounted to the oil passage, and a branched oil passage for a hydraulically-powered device of the engine that is configured to branch in a location of the oil passage extending from the oil pump to the oil cooler to deliver the oil to the hydraulically-powered device.

6 Claims, 17 Drawing Sheets

ENGINE

TECHNICAL FIELD

The present invention generally relates to an engine. More particularly, the present invention relates to an oil feeding system that delivers oil output from an oil pump to the engine to lubricate engine components and includes a branched oil passage to deliver the oil to a hydraulically-powered device.

BACKGROUND ART

In engines mounted in leisure vehicles such as motorcycles, oil reserved in an oil pan provided at a bottom portion of the engine or in an oil tank externally and separately mounted thereon is suctioned up by an oil pump driven in synchronization with an engine speed of the engine and is delivered through oil passages provided within the engine to lubricate and cool a crankshaft, a camshaft, or a transmission. In recent years, some engines have been equipped with a hydraulically-powered variable valve timing system configured to change a phase angle of the camshaft with respect to the crankshaft or a hydraulically-powered tensioner of a camshaft drive system of the engine. In such engines, the oil is fed to the system or the component to drive them (see e.g., Japanese Laid-Open Patent Application Publication No. Hei. 7-127661).

To be specific, the oil is output from the oil pump and is filtered by an oil filter. Thereafter, the oil is cooled to a specified temperature in an oil cooler. The resulting oil is fed to engine components to lubricate them and is delivered through a branched oil passage to the hydraulically-powered variable valve timing system, etc. to drive it.

In a conventional engine, the oil output from the oil pump generates a pressure loss in the oil cooler, the oil filter, etc., which is likely to be highly resistant to the oil flowing therein, and is then fed to a hydraulically-powered device such as the hydraulically-powered variable valve timing system. This causes a loss in the oil pressure for driving the hydraulically-powered device. Because the oil to be fed to the hydraulically-powered device is required to have a suitable oil pressure even when the engine is running at a low speed and thereby the oil output from the oil pump becomes less, it is desirable to minimize the pressure loss generated in the oil output from the oil pump. If a large-volume oil pump is equipped in the engine to obtain a sufficient oil pressure, then the size and cost of the engine increase. If the rotations of the oil pump increase in number, then pumping losses increase, causing reduced engine output efficiency.

In order to supply sufficient oil pressure to the hydraulically-powered device, an oil pump exclusively used for driving the hydraulically-powered device may be provided separately from the oil pump for lubrication. In that case, the number of oil pumps undesirably increases, leading to an increase in an installation space and cost.

SUMMARY OF THE INVENTION

The present invention addresses the above described conditions, and an object of the present invention is to provide an engine equipped with a hydraulically-powered device that is capable of reducing a pressure loss of oil delivered from an oil pump for lubrication and for driving a hydraulically-powered device to the hydraulically-powered device.

According to the present invention, there is provided an engine comprising an oil passage through which oil output from an oil pump flows; an oil cooler mounted to the oil passage; and a branched oil passage for a hydraulically-powered device of the engine that is configured to branch in a location of the oil passage extending from the oil pump to the oil cooler to deliver the oil to the hydraulically-powered device.

The oil cooler serves to water-cool or air-cool an outer wall of a sinuous oil passage thereof in which the oil flows to lower the temperature of the oil. Because of the resistance to the oil flowing in the sinuous oil passage, the oil generates a pressure loss. The oil cooler is typically disposed in close proximity to an outlet of the oil pump to cool the oil before the oil lubricates engine components. In the above construction, since the branched oil passage for the hydraulically-powered device through which the oil is delivered to the hydraulically-powered device branches in a location of the oil passage extending between the oil pump and the oil cooler, and the oil that is output from the oil pump and that flows through the branched oil passage for the hydraulically-powered device does not pass the oil cooler, the pressure loss generated in the oil delivered to the hydraulically-powered device can be reduced. Thus, a sufficient oil pressure can be obtained even during low engine speed. This enables the use of an oil pump with a small volume in the engine. As a result, the size and cost of the engine can be reduced. Furthermore, since an input torque of the oil pump can be reduced, an output efficiency of the engine can be improved.

At least a part of the branched oil passage for the hydraulically-powered device may include an oil guiding pipe extending outside of the engine.

In such a construction, since the oil guiding pipe is attached to the outside of the engine as the branched oil passage for the hydraulically-powered device, it is easily applicable to the existing engine as compared to the case where the oil passage for the hydraulically-powered device is entirely contained in the engine. As a result, the oil guiding pipe can be employed in a variety of engines. In addition, the size of the engine, excluding the oil guiding pipe, does not increase.

The oil guiding pipe may protrude from an outer wall of a lower portion of the engine and may be guided to the hydraulically-powered device located at an upper region of the engine.

In such a construction, since the long oil passage for the hydraulically-powered device that extends from the lower portion of the engine to the upper portion of the engine is not mounted in the interior of the engine, the size of the engine can be reduced.

The oil guiding pipe may be removably attached to the engine by joints provided at both ends thereof.

In such a construction, since the oil guiding pipe is externally attached to the engine easily, it is easily applicable to the existing engine. As a result, the oil guiding pipe can be employed in a variety of engines. In addition, since the oil guiding pipe is easily removed, maintenance of the oil guiding pipe is improved.

The oil guiding pipe may include a metal pipe and an elastic pipe which are coupled to each other.

Since the elastic pipe forms a part of the oil guiding pipe, the entire oil guiding pipe is able to absorb a load applied on the metal pipe to reduce a stress exerted on the metal pipe. In addition, since the oil guiding pipe includes separate pipes as described above, it is easily assembled into the engine. Further, since the elastic pipe forming a part of the oil guiding pipe allows for dimension errors when the oil guiding pipe is mounted to the engine, desired dimension precision can be reduced, and hence a manufacturing cost of the engine can be reduced.

The hydraulically-powered device may be a hydraulically-powered variable valve timing system configured to change a phase angle of a camshaft with respect to a crankshaft and/or a hydraulically-powered tensioner configured to apply a force to a chain guide that guides a chain through which the crankshaft is cooperatively coupled to the camshaft.

In such a construction, the oil with a sufficient oil pressure can be fed to the hydraulically-powered valve timing system or the hydraulically-powered tensioner which is required to stably operate with a suitable oil pressure.

The above and further objects and features of the invention will more fully be apparent from the following detailed description with accompanying drawings.

DETAILED DESCRIPTION OF THE PREFERRED EMBODIMENTS

Hereinafter, embodiments of an oil feeding system of an engine of the present invention will be described with reference to the accompanying drawings.

Embodiment 1

Figure 1:
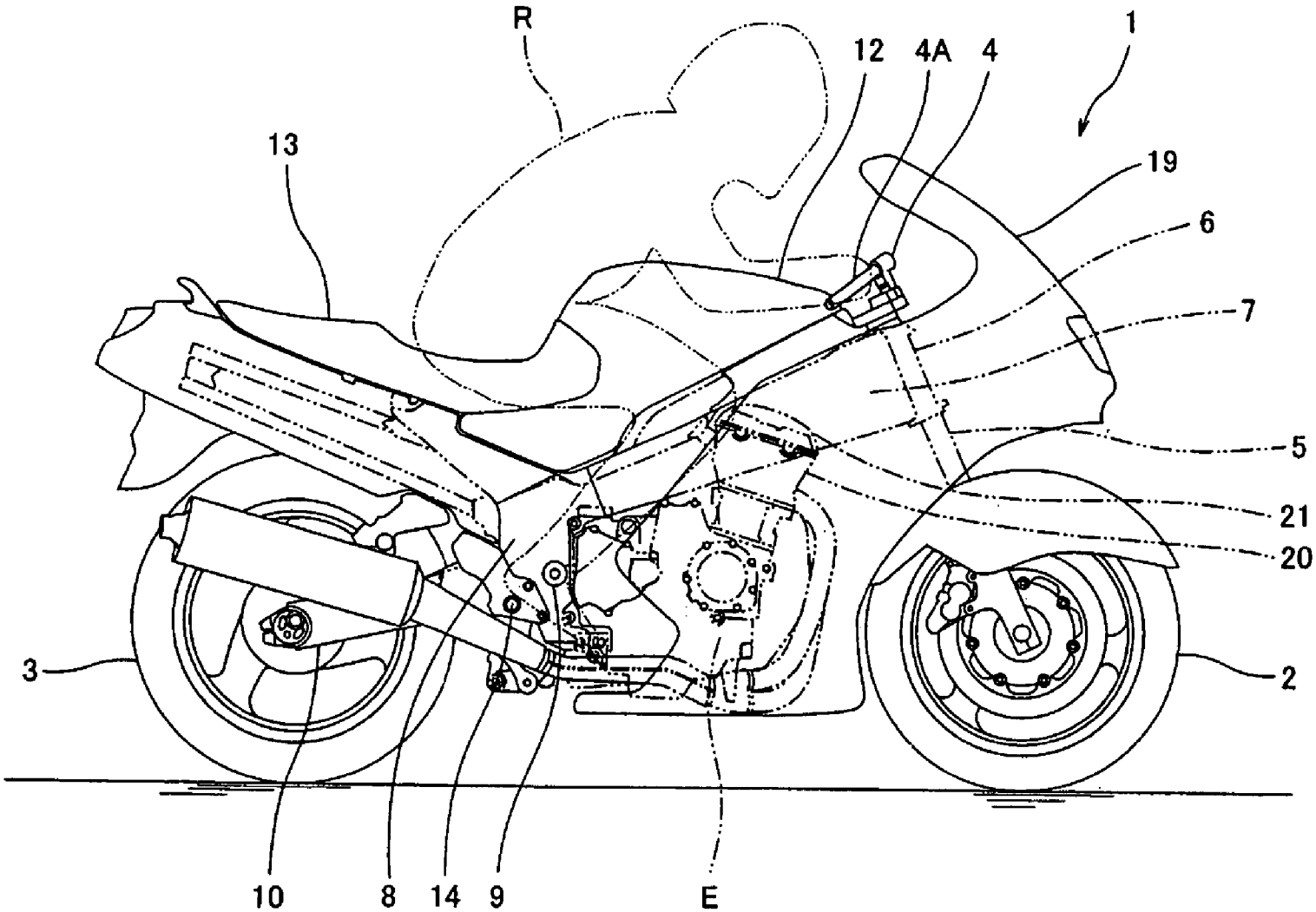
FIG. 1 is a right side view of a motorcycle in which an engine according to embodiments of the present invention is mounted.

FIG. 1 is a right side view of a motorcycle 1 in which an engine E according to an embodiment of the present invention is mounted. The motorcycle 1 is a road sport type motorcycle in which a rider R rides with an upper body leaning forward. Herein, directions are generally referenced from the perspective of the rider R mounting the motorcycle 1 of FIG. 1.

Turning now to FIG. 1, the motorcycle 1 includes a front wheel 2 and a rear wheel 3. The front wheel 2 is rotatably mounted to a lower region of a front fork 5 extending substantially vertically. The front fork 5 is mounted on a steering shaft (not shown) by an upper bracket (not shown) attached to an upper end thereof, and an under bracket located below the upper bracket. The steering shaft is rotatably supported by a head pipe 6. A bar-type steering handle 4 extending in a rightward and leftward direction is attached to the upper bracket. When the rider R rotates the steering handle 4 clockwise or counterclockwise, the front wheel 2 is turned to a desired direction around the steering shaft.

A pair of right and left main frames 7 (only right main frame 7 is illustrated in FIG. 1), forming a frame of the vehicle body, extend rearward from the head pipe 6. Pivot frames (swing arm brackets) 8 extend downward from rear regions of the main frames 7. A swing arm 10 is pivotally mounted at a front end portion thereof to a pivot 9 attached on the pivot frame 8. The rear wheel 3 is rotatably mounted to a rear end portion of the swing arm 10.

A fuel tank 12 is disposed above the main frames 7 and behind the steering handle 4. A straddle-type seat 13 is disposed behind the fuel tank 12. An engine E is mounted between and under the right and left main frames 7. The engine E is an inline four-cylinder four-cycle engine, and is a double overhead camshaft (DOHC) engine (see FIG. 2), including, in an interior of a cylinder head 20, a camshaft 30 configured to drive an intake valve and a camshaft 31 configured to drive an exhaust valve (see FIG. 2). An output of the engine E is transmitted, through a chain (not shown), to the rear wheel 3, which rotates to generate a driving force to drive the motorcycle 1. A cowling 19 which has an integral construction, is mounted to cover a front region of the motorcycle 1, i.e., front regions of the head pipe 6 and the main frames 7, and side regions of the engine E. Mounting the seat 13 to ride in the motorcycle 1, the rider R grips a grip 4A attached at an end portion of the steering handle 4 and puts feet on steps 14 provided in the vicinity of a rear region of the engine E. Under this condition, the rider R is ready to start-up the motorcycle 1.

Figure 2:
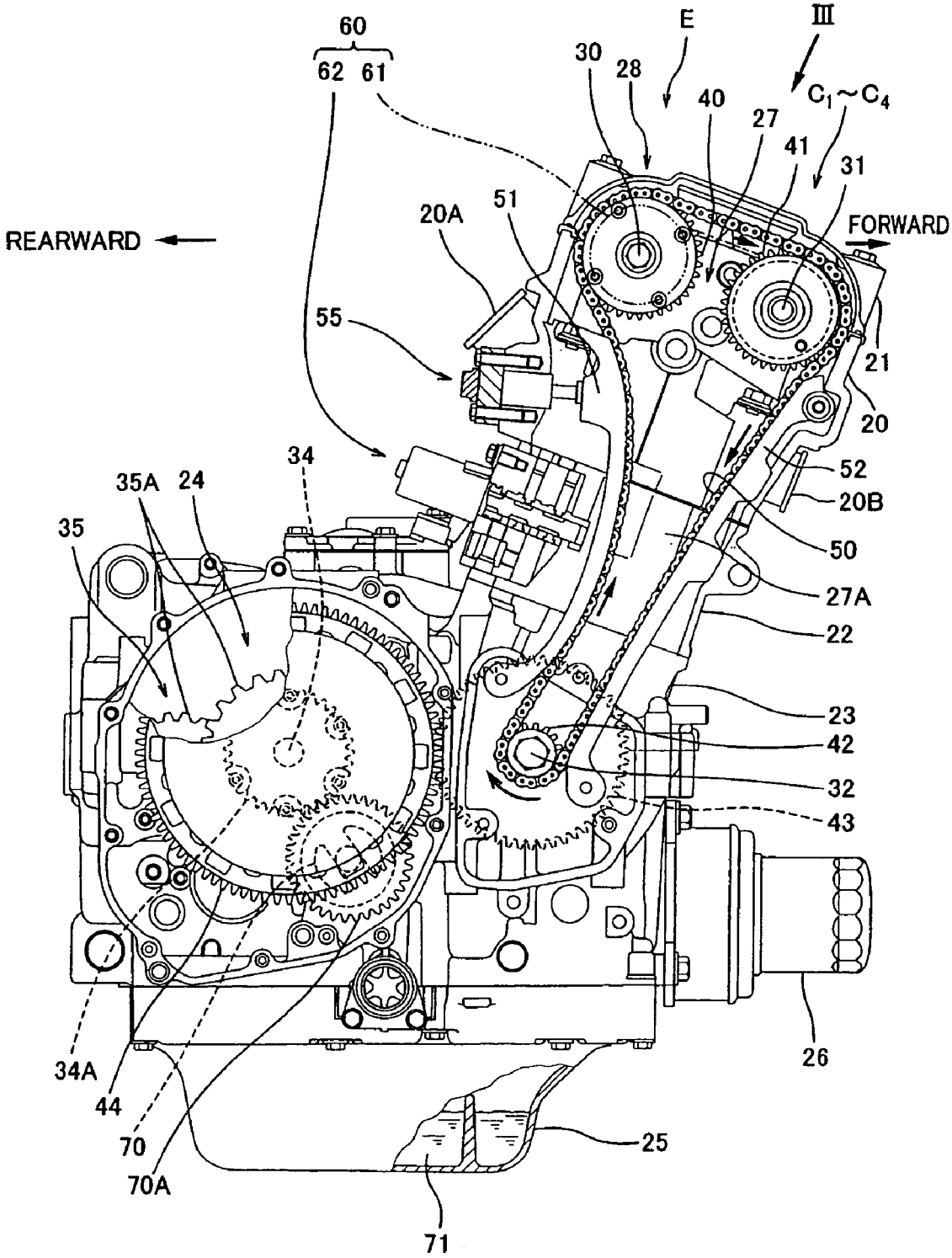
FIG. 2 is an enlarged right side view of the engine according to a first embodiment that is mounted in the motorcycle of FIG. 1, showing a structure of an interior of a chain tunnel provided on a right side of the engine.
Figure 3:
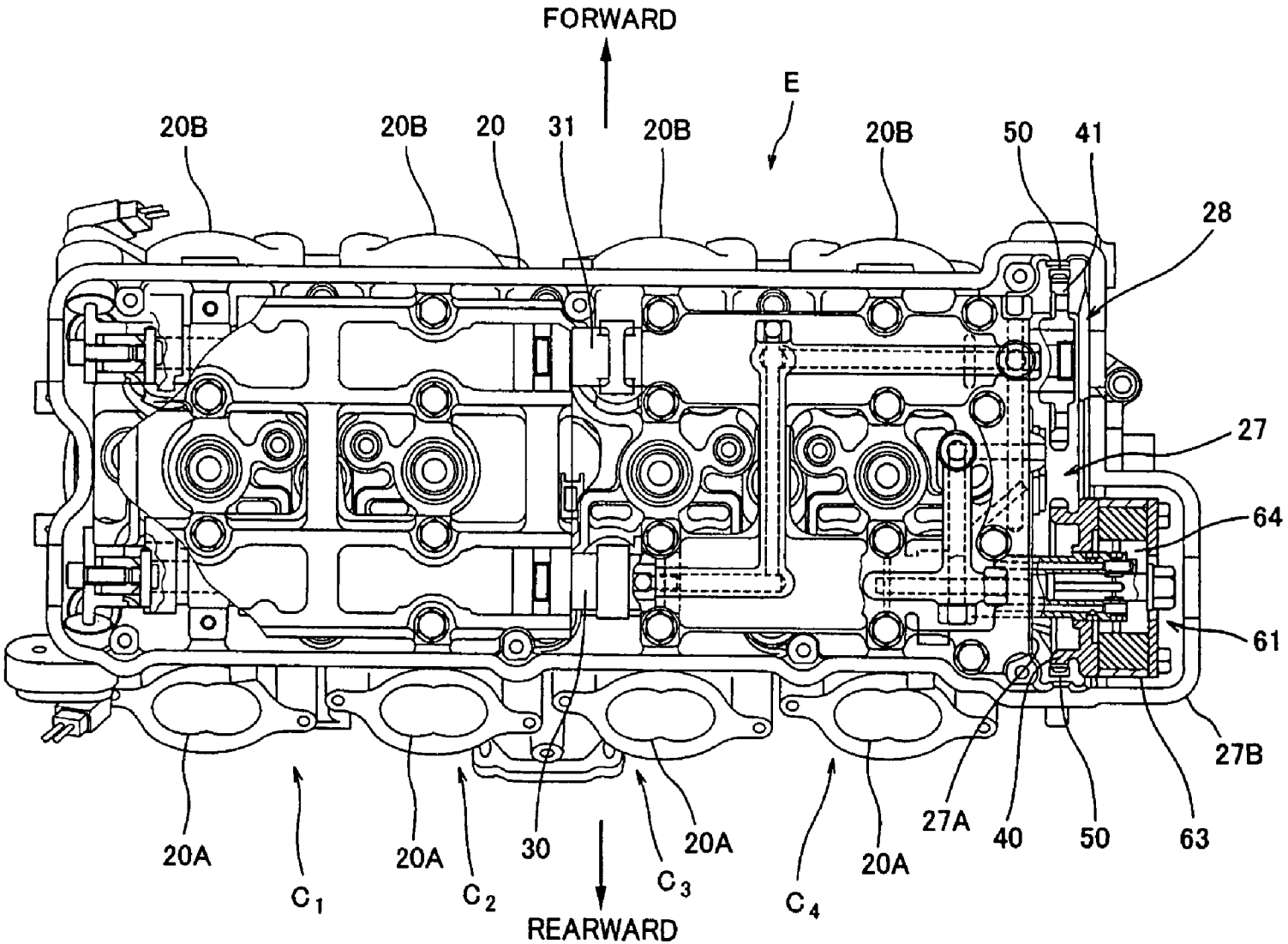
FIG. 3 is a plan view of the engine, taken in the direction of arrow of III of FIG. 2, showing a structure of an upper portion of a cylinder head from which a cylinder head cover is removed.

FIG. 2 is an enlarged right side view of the engine E according to the first embodiment mounted in the motorcycle of FIG. 1, showing a structure of an interior of a chain tunnel 27 provided on a right side of the engine E. FIG. 3 is a plan view of the engine E, taken in the direction of arrow of III of FIG. 2, showing a structure of an upper portion of the cylinder head 20 from which a cylinder head cover 21 is removed.

As shown in FIG. 3, the engine E includes four cylinders C1 to C4. As shown in FIG. 2, these cylinders C1 to C4 are inclined forward with a predetermined angle. As shown in FIG. 3, four intake ports 20A are provided at a rear portion of the cylinder head 20 so as to respectively correspond to the four cylinders C1 to C4. The four intake ports 20A are configured to open upward and rearward. Four exhaust ports 20B are provided at a front portion of the cylinder head 20 and are configured to open forward.

As shown in FIG. 2, the camshaft 30 and the camshaft 31 are mounted at an upper region of the cylinder head 20, and a cam holder (not shown) is provided over the camshafts 30 and 31 from above. The cylinder head cover 21 is provided over the cam holder and is fixed to the cylinder head 20. In this state, the camshaft 30 and the camshaft 31 are rotatably retained between the upper portion of the cylinder head 20 and a lower portion of the cam holder.

A cylinder block 22 is coupled to a lower portion of the cylinder head 20 and is configured to house a piston (not shown). A crankcase 23 is coupled to a lower portion of the cylinder block 22 and is configured to accommodate a crankshaft 32 that is mounted to extend in a width direction of the vehicle body and outputs its rotation. A chain tunnel outer wall portion 27B (its cross-sectional structure is illustrated in FIG. 3) that protrudes rightward is coupled at a periphery thereof to a right wall portion, namely, chain tunnel inner wall portion 27A of the cylinder head 20, the cylinder head cover 21, the cylinder block 22, and the crankcase 23 to cover the chain tunnel inner wall portion 27A. An inner space defined by the chain tunnel inner wall portion 27A and the chain tunnel outer wall portion 27B forms the chain tunnel 27 configured to accommodate a camshaft drive system 28. An oil pan 25 is mounted to a lower portion of the crankcase 23 and is configured to store oil used for lubrication and for driving the hydraulically-powered device. An oil filter 26 protrudes from a front portion of the crankcase 23 and is configured to filter oil suctioned up from the oil pan 25.

As shown in FIG. 2, the camshaft drive system 28 mounted in the interior of the cam chain tunnel 27 includes an intake cam sprocket 40, an exhaust cam sprocket 41, and a crank sprocket 42. To be specific, as shown in FIG. 3, a right end portion of the camshaft 30 protrudes from the chain tunnel inner wall portion 27A into the interior of the chain tunnel 27. The intake cam sprocket 40 is mounted on the right end portion of the camshaft 30. A right end portion of the camshaft 31 protrudes from the chain tunnel inner wall portion 27A into the interior of the chain tunnel 27. The exhaust cam sprocket 41 is mounted on the right end portion of the camshaft 31, and is configured to rotate integrally with the camshaft 31. As shown in FIG. 2, a right end portion of the crankshaft 32 protrudes from the chain tunnel inner wall portion 27A into the interior of the chain tunnel 27. The crank sprocket 42 is mounted on the right end portion of the crankshaft 32 and is configured to rotate integrally with the crankshaft 32.

A timing chain 50 is installed around the intake cam sprocket 40, the exhaust cam sprocket 41, and the crank sprocket 42. The intake cam sprocket 40 and the exhaust cam sprocket 41 are configured to rotate in cooperation with the rotation of the crank sprocket 42. Through the camshaft drive system 28 including the intake cam sprocket 40, the exhaust cam sprocket 41, the crank sprocket 42, and the timing chain 50, the rotation of the crankshaft 32 is transmitted to the camshaft 30 and the camshaft 31. In the engine E of this embodiment, the crankshaft 32 rotates clockwise in FIG. 2, and the timing chain 50, the intake cam sprocket 40, and the exhaust cam sprocket 41 also rotate clockwise.

Figure 7:
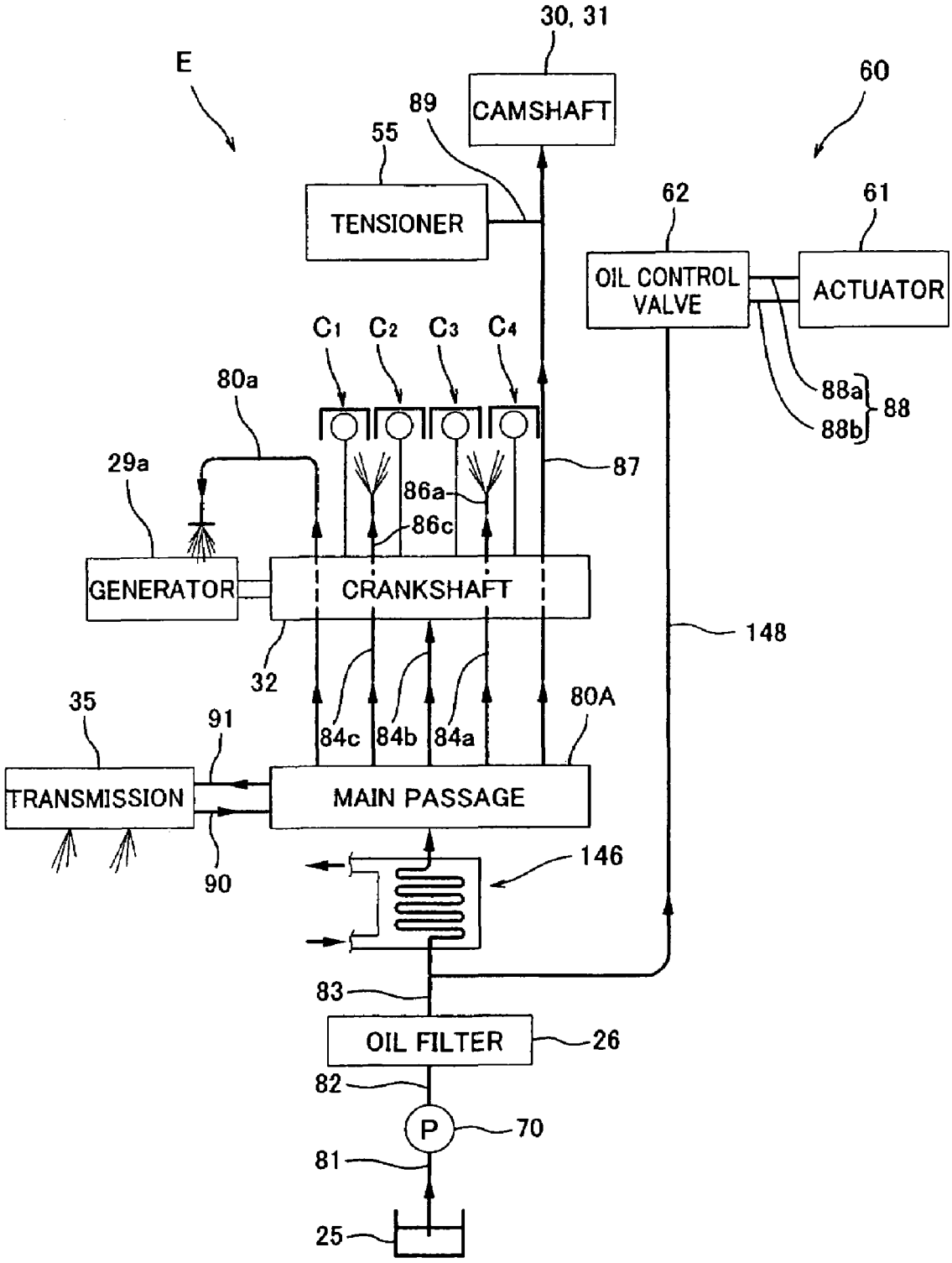
FIG. 7 is a schematic view of the oil passages illustrated in FIGS. 4 to 6.

As shown in FIG. 2, the engine E is equipped with a hydraulically-powered variable valve timing system 60 including a hydraulically-powered actuator 61 and an oil control valve 62 (see FIG. 7). The hydraulically-powered actuator 61 is mounted to a right end portion of the camshaft 30 and to an outer portion of the intake cam sprocket 40 (see FIG. 3). The oil control valve 62 is mounted to a rear wall portion of the cylinder block 22. The oil control valve 62 may alternatively be mounted to other portions, for example, a wall portion of the cylinder head 20. In that case, the oil control valve 62 may be disposed horizontally laterally of a movable chain tensioner 55 mentioned later. The oil control valve 62 may alternatively be mounted to a side wall portion or a front wall portion of the cylinder head 20 or otherwise may be mounted to the cylinder head cover 21.

As shown in FIG. 3, the hydraulically-powered actuator 61 includes a tubular housing 63 that has a bottom portion and is configured to rotate integrally with the intake cam sprocket 40, and a rotor 64 that is accommodated in the housing 63 and is configured to rotate integrally with the camshaft 30. The hydraulically-powered actuator 61 contains, in an interior of the housing 63, a plurality of advanced angle spaces and retarded angle spaces (not shown) that are defined by the housing 63 and the rotor 64. The hydraulically-powered actuator 61 is coupled to the oil control valve 62 through one or more of oil passages 80, typically through an eighth oil passage 88 (see FIG. 4) as mentioned later. The oil is delivered to the advanced angle spaces and to the retarded angle spaces through the one of the oil passages 80, such as the eighth oil passage 88, and a phase difference between the housing 63 and the rotor 64 changes according to a flow rate or an oil pressure of the delivered oil.

In the engine E constructed above, the rotation of the crankshaft 32 is transmitted, through the timing chain 50, to the intake cam sprocket 40 and the exhaust cam sprocket 41, which thereby rotate. The camshaft 31 rotates according to the rotation of the exhaust cam sprocket 41 in such a manner that the camshaft 31 rotates once with respect to two rotations of the crankshaft 32. The rotation of the intake cam sprocket 40 is transmitted to the camshaft 30 through the hydraulically-powered actuator 61 of the variable valve timing system 60. According to the flow rate or oil pressure controlled by the oil control valve 62, the camshaft 30 rotates with a predetermined phase difference with respect to the rotation of the crankshaft 32. The phase difference between the crankshaft 32 and the camshaft 30 changes according to the flow rate or the oil pressure changed by the oil control valve 62.

As shown in FIG. 2, a movable chain guide 51 and a fixed chain guide 52 are mounted in the interior of the chain tunnel 27. The movable chain guide 51 is disposed behind the timing chain 50 to extend substantially vertically. The movable chain guide 51 is mounted in such a manner that a lower end portion thereof is pivoted to a right wall portion of the crankcase 23 in the vicinity of a region above the crank sprocket 42, and an upper end portion thereof is located in the vicinity of a region below the intake cam sprocket 40. A hydraulically-powered tensioner 55 is mounted to a rear wall portion of the cylinder head 20 and is configured to apply a forward force to an upper portion of the chain guide 51 to enable the timing chain 50 to be supported from behind and to have a suitable tension.

The fixed chain guide 52 mounted in the interior of the chain tunnel 27 extends substantially vertically in front of the timing chain 50 in a location near and forward of the crank sprocket 42 to a location near and under the exhaust cam sprocket 41. The chain guide 52 is provided with a groove (not shown) formed at a rear region thereof to extend in a longitudinal direction to allow the timing chain 50 to be supported from forward. To be specific, a front region of the timing chain 50 is accommodated in the groove formed at the rear region of the fixed chain guide 52 so that the timing chain 50 is movable along the groove.

An output gear 43 is mounted on a right side portion of the crankshaft 32 in the interior of the crankcase 23 and is configured to rotate integrally with the crankshaft 32. Through the output gear 43, the rotation of the crankshaft 32 is output. A transmission space 24 is formed at a rear portion of the crankcase 23. An input shaft 34 and an output shaft (not shown) are accommodated in the transmission space 24 to extend substantially in parallel with the crankshaft 32. A plurality of gears 35A are mounted on the input shaft 34 and the output shaft, thereby forming the transmission 35. An input gear 44 is mounted on a right end portion of the input shaft 34, and is configured to mesh with the output gear 43 of the crankshaft 32 and to rotate integrally with the input shaft 34. In this construction, the output of the engine E is transmitted from the crankshaft 32 to the input shaft 34 through the output gear 43 and the input gear 44. Further, the transmission 35 changes a rotational speed of the rotation, and the resulting rotation is output to the rear wheel 3 (FIG. 1).

The above mentioned engine E includes a trochoidal rotor oil pump 70. The oil pump 70 is provided with a pump driven gear 70A adapted to mesh with a pump drive gear 34A mounted on the input shaft 34 of the transmission 35. The oil pump 70 is driven according to the rotation of the crankshaft 32. The engine E is provided with an oil passage network 80 comprised of one or more oil passages for lubrication (see FIG. 4) through which oil 71 suctioned up by the oil pump 70 from the oil pan 25 is delivered to the transmission 35 and to the engine components.

Figure 4:
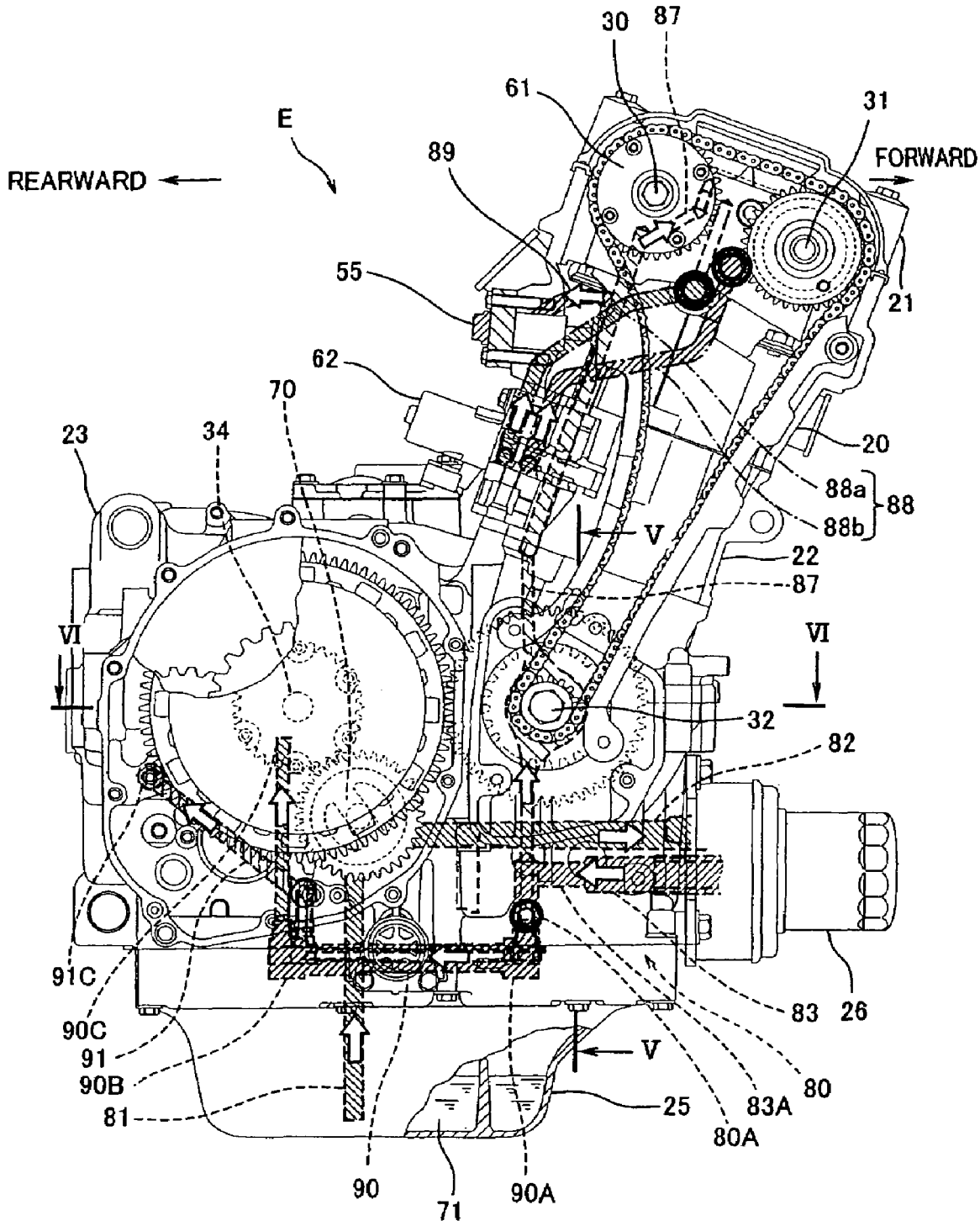
FIG. 4 is a right side view showing a structure of oil passages included in an oil feeding system of the engine of FIG. 2.
Figure 5:
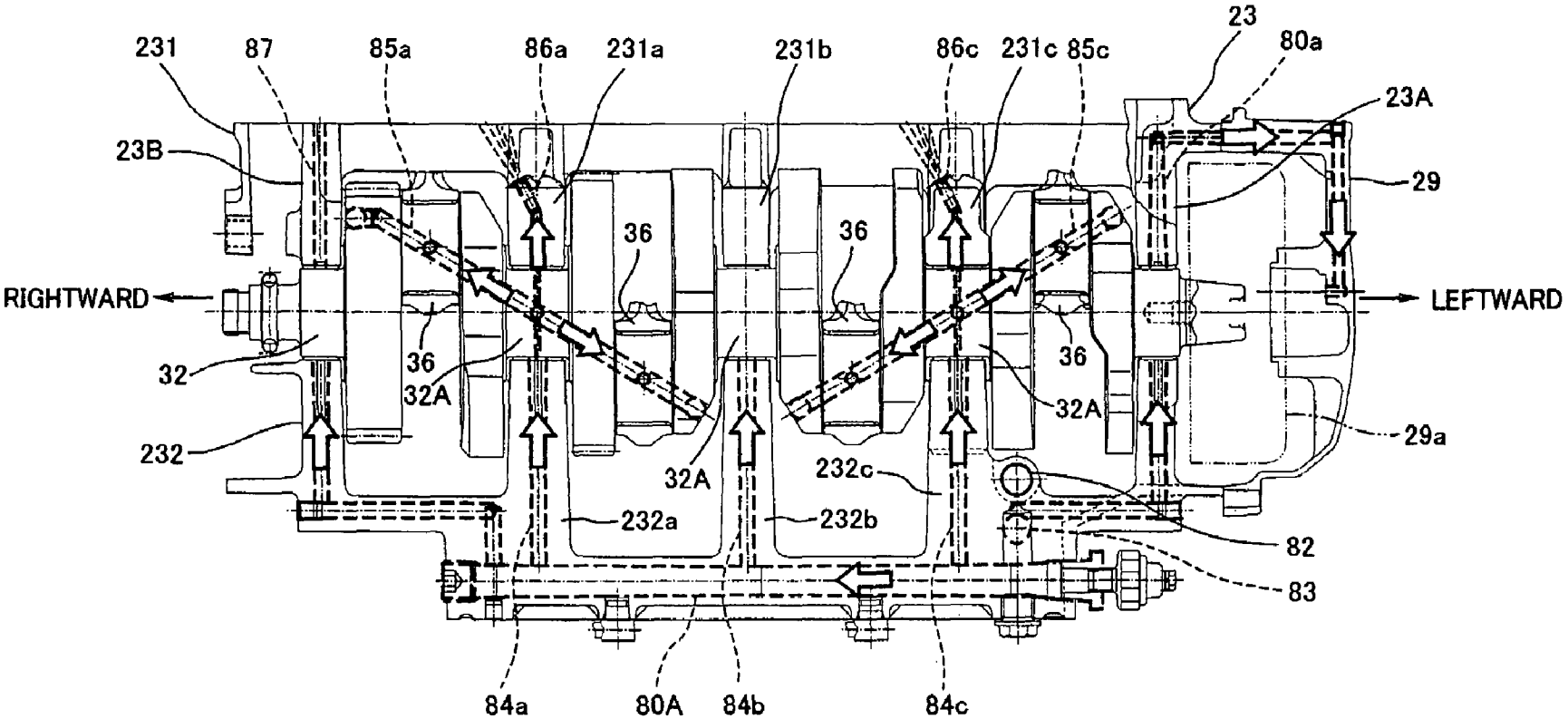
FIG. 5 is a cross-sectional view of the engine, taken substantially along line V-V of FIG. 4.
Figure 6:
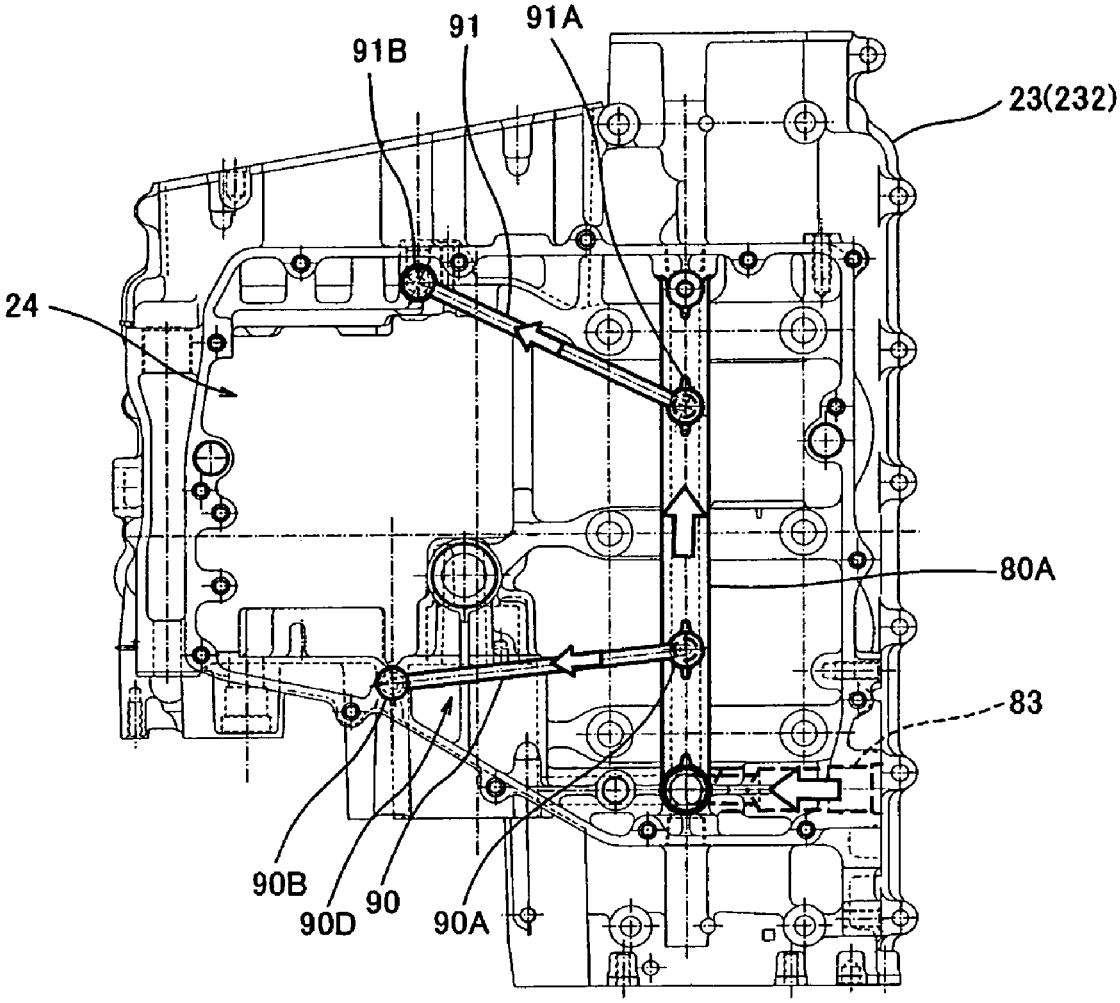
FIG. 6 is a cross-sectional view of the engine, taken substantially along line VI-VI of FIG. 4.

With reference to FIGS. 4 to 7, the oil passage network 80 included in an oil feeding system of the engine E will be described. FIG. 4 is a side view showing the structure of the oil passage network 80 in the engine E of FIG. 2. FIG. 5 is a cross-sectional view of the engine E, taken substantially along line V-V of FIG. 4, showing a vertical section of the crankcase 23 and its internal structure. FIG. 6 is a cross-sectional view of the engine E, taken substantially along line VI-VI of FIG. 4, showing a horizontal section of an internal structure of the crankcase 23. FIG. 7 is a schematic view of the oil passage network 80 illustrated in FIGS. 4 to 6.

Oil passage network 80 may include a plurality of interconnected oil passages, as described below. As shown in FIG. 4, a first oil passage 81 of oil passage network 80 extends upward from the oil pan 25 to an inlet of the oil pump 70. An oil strainer (not shown) is mounted to a lower end portion of the first oil passage 81. A second oil passage 82 extends forward from an outlet of the oil pump 70 to an inlet of the oil filter 26 located at the front portion of the crankcase 23. A third oil passage 83 to which an oil cooler 146 (see FIG. 7) is attached extends rearward from an outlet of the oil filter 26 to a location under the crankshaft 32 and is coupled at a tip end 83A to a main passage (distributing passage) 80A with a larger diameter. The oil pump 70 is driven to suction up the oil from the oil pan 25 through the first oil passage 81. The oil is delivered to the oil filter 26 through the second oil passage 82. The oil filter 26 filters the oil. The oil is delivered to the oil cooler 146 (FIG. 7). The cooled oil is delivered to the main passage 80A through the third oil passage 83.

As shown in FIGS. 5 and 6, the main passage 80A extends in a rightward and leftward direction at a lower portion of the crankcase 23. As mentioned later, a plurality of oil passages extend from the main passage 80A, including a transmission oil passage extending to the transmission 35 and an engine body oil passage extending to the portions other than the transmission 35. Below, the engine body oil passage will be first described and then the transmission oil passage will be described.

As shown in FIG. 5, the crankcase 23 of the engine E includes an upper crankcase 231 and a lower crankcase 232 which are joined to each other. Bulkheads 231*a* to 231*c* and bulkheads 232*a* to 232*c* protrude inwardly from the inner wall of the upper crankcase 231 and the inner wall of the lower crankcase 232, respectively in such a manner that the bulkheads 231*a* to 231*c* correspond to the bulkheads 232*a* to 232*c*, respectively. The crankshaft 32 is rotatably mounted to the crankcase 23 in such a manner that crank journals 32A are retained from above and below, between the bulkheads 231*a* and 232*a*, between the bulkheads 231*b* and 232*b*, and between the bulkheads 231*c* and 232*c*.

As shown in FIG. 5, fourth oil passages 84*a* to 84*c* included in the engine body oil passage extend upward from the main passage 80A through the interiors of the bulkheads 232*a* to 232*c* of the lower crankcase 232. Through the fourth oil passages 84*a* to 84*c* extending upward in the interior of the bulkheads 232*a* to 232*c*, the oil is fed from the main passage 80A to contact portions between the crank journals 32A and the bulkheads 231*a* to 231*c* and 232*a* to 232*c* to lubricate the contact portions.

The crankshaft 32 is provided with fifth oil passages 85*a* and 85*c* included in the engine body oil passage and connected to the left fourth oil passage 84*a* and the right fourth oil passage 84*c*, respectively. Through the fifth oil passages 85*a* and 85*c*, a part of the oil flowing from the fourth oil passages 84*a* and 84*c* is fed to contact portions between the crankshaft 32 and connecting rods 36 to lubricate the contact portions and may be sometimes fed to a balancer shaft (not shown) of the engine E. The left bulkhead 231*a* and the right bulkhead 231*c* of the upper crankcase 231 are provided with sixth oil passages 86*a* and 86*c* included in the engine body oil passage, which are connected to the fourth oil passages 84*a* and 84*c* formed in the left bulkhead 232*a* and the right bulkhead 232*c* of the lower crankcase 232, respectively. The sixth oil passages 86*a* and 86*c* open at upper regions of the bulkheads 231*a* and 231*c*. A part of the oil flowing from the fourth oil passages 84*a* and 84*c* is injected toward back surfaces of pistons (not shown) through the openings of the sixth oil passages 86*a* and 86*c*. Oil passages through which the oil is injected toward the back surfaces of the pistons are not intended to be the sixth oil passages 86*a* and 86*c*, but may be provided at the center bulkhead 231*b* as necessary, or alternatively four oil passages may be provided to correspond to each of the four pistons.

As shown in FIG. 5, a generator oil passage 80*a* included in the engine body oil passage network 80 extends from a left end portion of the main passage 80A and through an interior of a left wall portion 23A of the crankcase 23. The generator oil passage 80*a* extends upward in the interior of the right wall portion 23A of the crankcase 23, within a wall portion of a generator cover 29, and to a generator 29*a* accommodated in an interior of the generator cover 29. Through the generator oil passage 80*a*, a part of the oil is fed from the main passage 80A to the generator 29*a* to cool the generator 29*a*.

A seventh oil passage 87 included in the engine body oil passage network 80 extends from a right end portion of the main passage 80A and through an interior of a right wall portion 23B of the crankcase 23. As shown in FIG. 4, the seventh oil passage 87 extends upward in an interior of the left wall portion 23B (FIG. 5) of the crankcase 23, through the wall portions of the cylinder block 22 and the cylinder head 20, and to the upper region of the cylinder head 20. The oil is fed to the camshaft 30 and the camshaft 31 through the seventh oil passage 87 to lubricate the camshafts 30 and 31.

As shown in FIG. 7, an oil passage (branched oil passage) 148 for the hydraulically-powered device that branches in a location of a third oil passage 83 extending between the oil filter 26 and the oil cooler 146 is coupled to the oil control valve 62. As shown in FIGS. 4 and 7, an eighth oil passage 88 included in the engine body oil passage network 80 extends from the oil control valve 62. The eighth oil passage 88 includes two sub-oil passages 88*a* and 88*b*. The sub-oil passage 88*a* is coupled to the advanced angle space (not shown) of the hydraulically-powered actuator 61 through the oil control valve 62. The sub-oil passage 88*b* is coupled to the retarded angle space (not shown) of the hydraulically-powered actuator 61 through the oil control valve 62. The oil is delivered to the oil control valve 62 through the oil passage 148. The oil control valve 62 suitably controls a flow rate and an oil pressure of the oil, and the resulting oil is delivered through the sub-oil passages 88*a* and 88*b*, to the advanced angle space and the retarded angle space to drive the hydraulically-powered actuator 61.

A ninth oil passage 89 included in the engine body oil passage network 80 extends from a region of the seventh oil passage 87 which corresponds to the cylinder head 20. The ninth oil passage 89 is coupled to the hydraulically-powered tensioner 55. The oil is fed to the hydraulically-powered tensioner 55 through the ninth oil passage 89 to drive the tensioner 55.

As shown in FIG. 6, a tenth oil passage 90 and an eleventh oil passage 91 included in the transmission oil passage extend rearward from locations of the main passage 80A. As shown in FIG. 6, the tenth oil passage 90 is coupled at an upstream end portion 90A to the main passage 80A, and then extends rearward to form an intermediate portion 90B located under the transmission 35. Further, as shown in FIG. 4, the tenth oil passage 90 extends upward to form a downstream end portion 90C located near the input shaft 34. As shown in FIG. 6, the eleventh oil passage 91 is coupled at an upstream end portion 91A to the main passage 80A, and then extends rearward to form an intermediate portion 91B located under the transmission 35. Further, the eleventh oil passage 91 extends upward and rearward to form a downstream end portion 91C (see FIG. 4) located near the output shaft (not shown). The oil is fed to the input shaft 34, the output shaft, and the transmission 35 through the tenth oil passage 90 and the eleventh oil passage 91, to lubricate them (see FIG. 4).

Figure 8:
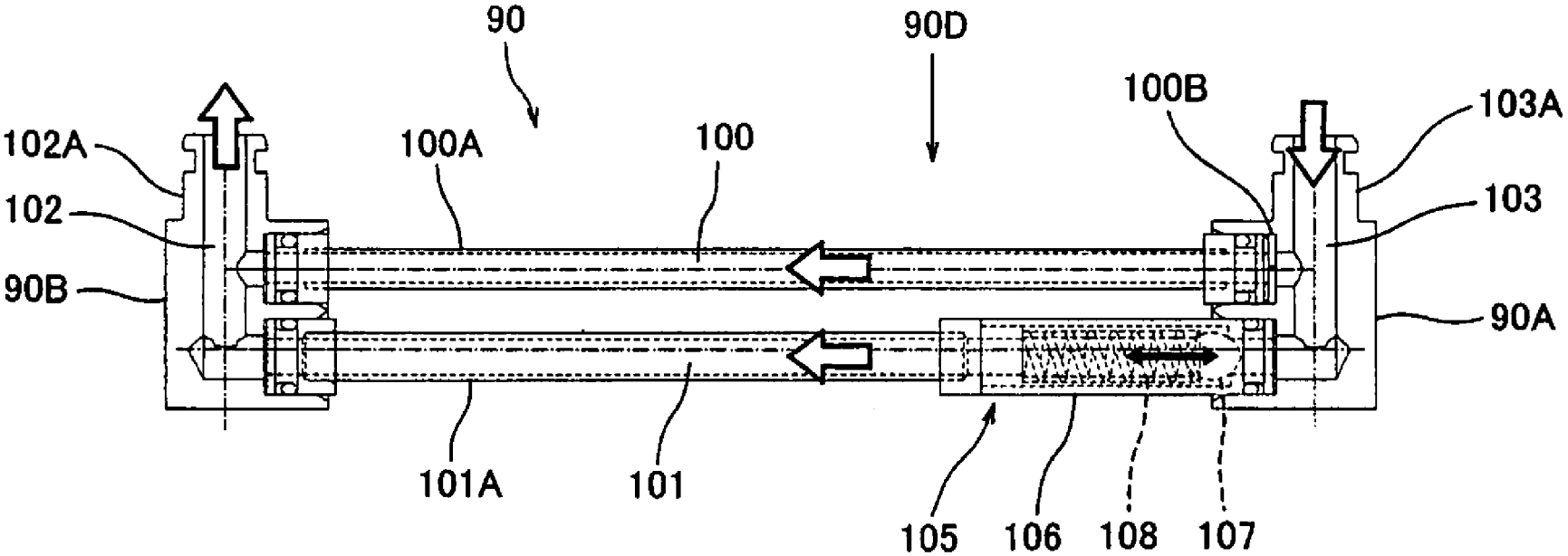
FIG. 8 is an enlarged side view showing a structure of a part of the oil passage of the engine of FIG. 2, between an upstream end portion and an intermediate portion in a flow direction of the oil.

FIG. 8 is an enlarged side view of a structure of a part of the tenth oil passage 90, showing an oil control portion 90D provided between the upstream end portion 90A and the intermediate portion 90B. As shown in FIG. 8, the oil control portion 90D includes a main (first) oil passage 100 and a sub-oil passage 101 arranged in a vertical direction so as to extend in parallel with each other. The main oil passage 100 and the sub-oil passage 101 are formed of a pipe member 100A and a pipe member 101A of a substantially equal length. The sub-oil passage 101 has a diameter slightly larger than that of the main oil passage 100. A joint 103A located on an upstream side and a joint 102A located on a downstream side, which have internal passages 102 and 103, respectively, are coupled to both end portions of the pipe members 100A and 101A. The main oil passage 100 and the sub-oil passage 101 are connected to the internal passages 102 and 103. As shown in FIGS. 4 and 8, the joint 103A on the upstream side is connected to the main passage 80A and the joint 102A on the downstream side is connected to the downstream end portion 90C (see FIG. 4) of the tenth oil passage 90.

A restricting portion 100B is provided at an upstream end of the main oil passage 100. The restricting portion 100B is formed to have an inner diameter smaller than a passage diameter of a region of the main oil passage 100 which is in the vicinity of the restricting portion 100B. This makes it possible to suppress a pressure decrease in the oil 71 in the interior of the main passage 80A when the engine speed of the engine E is low.

A relief valve 105 is provided between an upstream end of the sub-oil passage 101 and the joint 103A. The relief valve 105 contains, in an interior of a tubular housing 106, a ball 107 having a diameter smaller than an inner diameter of the housing 106, and a coil spring 108 configured to apply a force to the ball 107 in an opposite direction to a flow direction of the oil in the housing 106. With the ball 107 in a predetermined position near the upstream end portion 90A of the housing 106, the relief valve 105 is closed so as not to permit flow of the oil in the sub-oil passage 101. On the other hand, with the ball 107 located to be away in the flow direction of the oil from the predetermined position near the upstream end portion 90A of the housing 106, the relief valve 105 is opened, permitting the oil to flow in the sub-oil passage 101. Since the eleventh oil passage 91 has a structure similar to that of the tenth oil passage 90, it will not be further described.

In the engine E constructed above, when the crankshaft 32 rotates, the oil pump 70 causes the oil 71 to be suctioned up from the oil pan 25. The oil pump 70 causes the oil 71 to be delivered to the main passage 80A through the oil filter 26 and the oil cooler 146, and further to engine components of the engine E. To be specific, the oil 71 is delivered from the main passage 80A to an upper region of the engine E to lubricate the camshafts 30 and 31 to lubricate them. Further, the oil 71 is fed to the hydraulically-powered tensioner 55 to enable the tensioner 55 to apply a force to the movable chain guide 51. Furthermore, the oil 71 is delivered from the main passage 80A to a rear region of the engine E, for example, the transmission 35, etc., through the tenth oil passage 90 and the eleventh oil passage 91 to lubricate them. The oil 71 is delivered from the oil pump 70, through the oil filter 26, and through the oil passage 148 that branches in a location of the third oil passage 83 to the oil control valve 62 without passing through the oil cooler 146, and then is fed to the hydraulically-powered actuator 61 to enable the actuator 61 to determine a rotational phase of the camshaft 30.

One or more of the oil passages in oil passage network 80, in particular, the eighth oil passage 88, the ninth oil passage 89, and the oil passage 148 for the hydraulically-powered device may be formed in the interior of the wall portion of the engine E or otherwise may be a pipe member externally attached to the wall portion of the engine E.

Because the oil pump 70 is driven in cooperation with the rotation of the crankshaft 32, the pressure of the oil 71 in the oil passage network 80 is relatively low when the rotational speed of the crankshaft 32 is low, and increases with an increase in the rotational speed of the crankshaft 32. So, when the rotational speed of the crankshaft 32 is low, the pressure of the oil 71 at the upstream end of the sub-oil passage 101 in the oil control portion 90D of the tenth oil passage 90 is low, and the relief valve 105 provided in the sub-oil passage 101 is closed. In this state, the oil 71 is fed to the transmission 35 only through the main oil passage 100. Since the oil 71 flows only through the main oil passage 100 in the tenth oil passage 90, the pressure of the oil 71 in the oil passage 80A is maintained at a predetermined value or more so that the oil 71 is fed in sufficient pressure or amount to the camshaft 30, the camshaft 31, the hydraulically-powered actuator 61 of the variable valve timing system 60, and the hydraulically-powered tensioner 55 which are positioned at the upper region of the engine E.

The pressure of the oil 71 increases with an increase in the rotational speed of the crankshaft 32. When the pressure of the oil 71 becomes a predetermined value or more, the relief valve 105 provided in the sub-oil passage 101 is opened, in the oil control portion 90D of the tenth oil passage 90. As a result, the oil 71 is fed, through the main oil passage 100 and the sub-oil passage 101 in the tenth oil passage 90, to the transmission 35 in sufficient pressure and/or amount required for high-speed running of the engine E.

In the above constructed engine E, the relief valve 105 is opened and closed in the oil control portion 90D according to the pressure of the oil 71 so that the pressure (or flow rate) of the oil 71 delivered toward the cylinder head 20 and the pressure (or flow rate) of the oil 71 delivered toward the transmission 35 are individually controlled. Therefore, in a whole engine speed range of the engine E, the oil 71 is fed in sufficient pressure or amount to the transmission 35, the crankshaft 23, and the camshafts 30 and 31. In addition, with the engine E running at a low engine speed, an oil pressure sufficient to suitably drive the variable valve timing system 60 and the hydraulically-powered tensioner 55 is obtained.

The oil passage 148 for the hydraulically-powered device through which the oil 71 is fed to the hydraulically-powered actuator 61 of the variable valve timing system 60 branches in a location upstream of the oil cooler 146 which tends to cause a pressure loss in the oil flowing therein. Therefore, the pressure loss of the oil 71 delivered to the hydraulically-powered actuator 61 is reduced. Since a sufficient oil pressure is obtained, an oil pump 70 with a small volume can be used, leading to reduction of the size and cost of the whole engine E. In addition, an input torque of the pump can be reduced. As a result, an output efficiency of the engine E is improved.

Since an operation of a relief valve (not shown) provided in the sub-oil passage of the eleventh oil passage 91 is similar to that of the relief valve 105 provided in the sub-oil passage 101 of the tenth oil passage 90, it will not be further described. The oil control portion 90D may include an electromagnetic relief valve, instead of the mechanically-driven relief valve 105 composed of the ball 107 and the coil spring 108 as illustrated in this embodiment.

Furthermore, the oil control portion 90D of the tenth oil passage 90 may be configured to include another structure instead of the main oil passage 100 and the sub-oil passage 101 provided with the relief valve 105.

Figure 9:
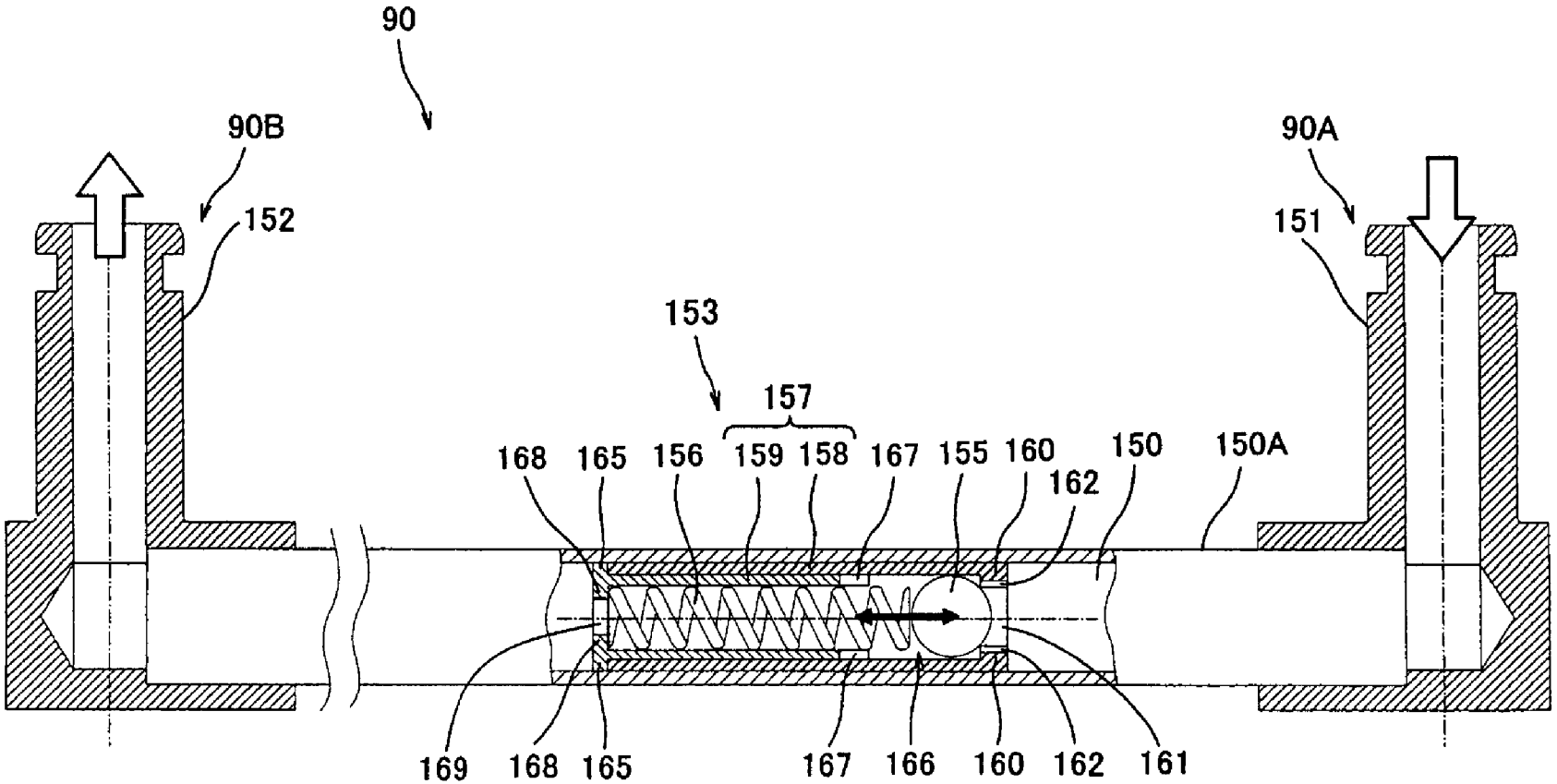
FIG. 9 is a side view showing an alternative structure of the oil passage of FIG. 8.

FIG. 9 is a side view showing an alternative structure of the oil passages of FIG. 8. As shown in FIG. 9, an oil control portion 153 is mounted between the upstream end portion 90A and the intermediate portion 90B of the tenth oil passage 90 of FIG. 4. As shown in FIG. 9, a pipe member 150A having an internal passage 150 is mounted between the upstream end portion 90A and the intermediate portion 90B of the tenth oil passage 90. An upstream end of the pipe member 150A is connected to the main passage 80A (FIG. 4) through a joint 151, and a downstream end portion of the pipe member 150A is connected to a downstream end portion 90C (FIG. 4) of the tenth oil passage 90 through a joint 152. The oil control portion 153 is provided at a position of the internal passage 150 of the pipe member 150A. The oil control portion 153 is tubular and is constructed to accommodate a ball 155 and a coil spring 156 in a housing 157. The oil control portion 153 is forcibly fitted into the internal passage 150 of the pipe member 150A.

The housing 157 includes a substantially tubular outer housing 158 configured to accommodate the ball 155 and a substantially tubular inner housing 159 that is internally fitted to the outer housing 158 and is configured to accommodate the spring 156. The outer housing 158 has an inner diameter slightly larger than a diameter of the ball 155, and is provided at an upstream end portion thereof with a reduced-diameter portion 160 protruding radially inward from an inner peripheral surface of the outer housing 158. An upstream opening 161 defined by the reduced-diameter portion 160 has a diameter slightly smaller than a diameter of the ball 155. One or a plurality of cut portions 162 are formed at an inner region of the reduced-diameter portion 160 along the periphery of the upstream opening 161. With the ball 155 positioned within the outer housing 158 in contact with the reduced-diameter portion 160, the interior of the housing 157 communicates with outside through only the cut portion 162.

The inner housing 159 is internally fitted into the outer housing 158 through an opening located on a downstream side. The inner housing 159 has an outer diameter substantially equal to an inner diameter of the outer housing 158, and has an inner diameter slightly smaller than a diameter of the ball 155. An axial dimension of the inner housing 159 is smaller than an axial dimension of the outer housing 158. A flange portion 165 is formed at a downstream end of the inner housing 159 so as to protrude radially outward further than an outer peripheral portion of the inner housing 159. With the inner housing 159 fitted into the outer housing 158, the flange portion 165 is in contact with a downstream end portion of the outer housing 158. With the inner housing 159 fitted into the outer housing 158, the ball 155 is accommodated in a space 166 formed between the reduced-diameter portion 160 of the outer housing 158 and an upstream end portion of the inner housing 159. The ball 155 is movable in the axial direction of the housing 157 in the space 166.

One or a plurality of cut portions 167 are formed at the upstream end portion of the inner housing 159 along the periphery of the inner housing 159. An opening area of the cut portion 167 is larger than an opening area of the cut portion 162. When the ball 155 moves in the flow direction of the oil to contact the upstream end portion of the inner housing 159, the space 166 is able to communicate with the interior of the inner housing 159 though only the cut portion 167. The coil spring 156 is accommodated in the interior of the inner housing 159. The coil spring 156 has a diameter substantially equal to the inner diameter of the inner housing 159, and is mounted in such a manner that an axial direction of the coil spring 156 conforms to an axial direction of the inner housing 159. A reduced-diameter portion 168 is formed at a downstream end portion of the inner housing 159 so as to protrude radially inward from an inner peripheral surface of the inner housing 159. The reduced-diameter portion 168 defines a downstream opening 169 through which the interior of the housing 157 communicates with outside. The coil spring 156 is mounted in such a manner that a downstream end of the coil spring 156 is in contact with the reduced-diameter portion 168 and an upstream end thereof is in contact with the ball 155 to apply a force to the ball 155 in an opposite direction to the flow direction of the oil in the housing 157.

When a pressure difference between the upstream side and the downstream side of the oil control portion 153 is a predetermined value or less, the oil control portion 153 is closed with the ball 155 in contact with an inner side of the reduced-diameter portion 160 of the outer housing 158. As a result, the oil 71 flows through only the cut portion 162 formed on the reduced-diameter portion 160 of the outer housing 158. When the pressure of the oil 71 on the upstream side becomes a predetermined value or more, the ball 155 moves in the flow direction of the oil against elasticity of the coil spring 156 and contacts the upstream end portion of the inner housing 159, causing the oil control portion 153 to be opened. As a result, the oil 71 flows in a large amount through the cut portion 167 which is larger than the cut portion 162 and is formed at the upstream end portion of the inner housing 159.

In the tenth oil passage 90 constructed above, the pressure of the oil 71 in the interior of the main passage 80A is high when the rotational speed of the crankshaft 32 is high. Under this condition, the oil 71 may be fed in sufficient pressure and/or amount to the crankshaft 32, and the camshafts 30 and 31, and an oil pressure sufficient to drive the variable valve timing system 60 and the hydraulically-powered tensioner 55 may be obtained. In addition, since the pressure of the oil 71 in the tenth oil passage 90 is high, the oil control portion 153 is opened to enable the oil 71 to be fed in sufficient pressure and/or amount to the transmission 35.

On the other hand, when the rotational speed of the crankshaft 32 is low, the pressure of the oil 71 in the tenth oil passage 90 is low. When the pressure of the oil 71 becomes a predetermined value or less, the oil control portion 153 operates to be closed. Under this condition, since the pressure of the oil 71 in the main passage 80A is maintained at a predetermined value or more, the oil 71 can be fed in required amount to the crankshaft 32 and to the camshafts 30 and 31. In addition, an oil pressure sufficient to drive the variable valve timing system 60 and the hydraulically-powered tensioner 55 is obtained. With the oil control portion 153 closed, the oil 71 is fed in a sufficient amount to the transmission 35 through the cut portion 162.

The oil control portion 153 illustrated in FIG. 9 enables the oil 71 to be fed in a suitable pressure and/or amount to the transmission 35 and the portions other than the transmission 35. It will be appreciated that the structure illustrated in FIG. 9 may be applied to the eleventh oil passage 91. Also, a system similar to the oil control portion 90D of FIG. 8 or the oil control portion 153 of FIG. 9 may be provided in other oil passages, for example, the seventh oil passage 87, the eighth oil passage 88, and the ninth oil passage 89, as well as in the tenth oil passage 90 and the eleventh oil passage 91.

Embodiment 2

Figure 10:
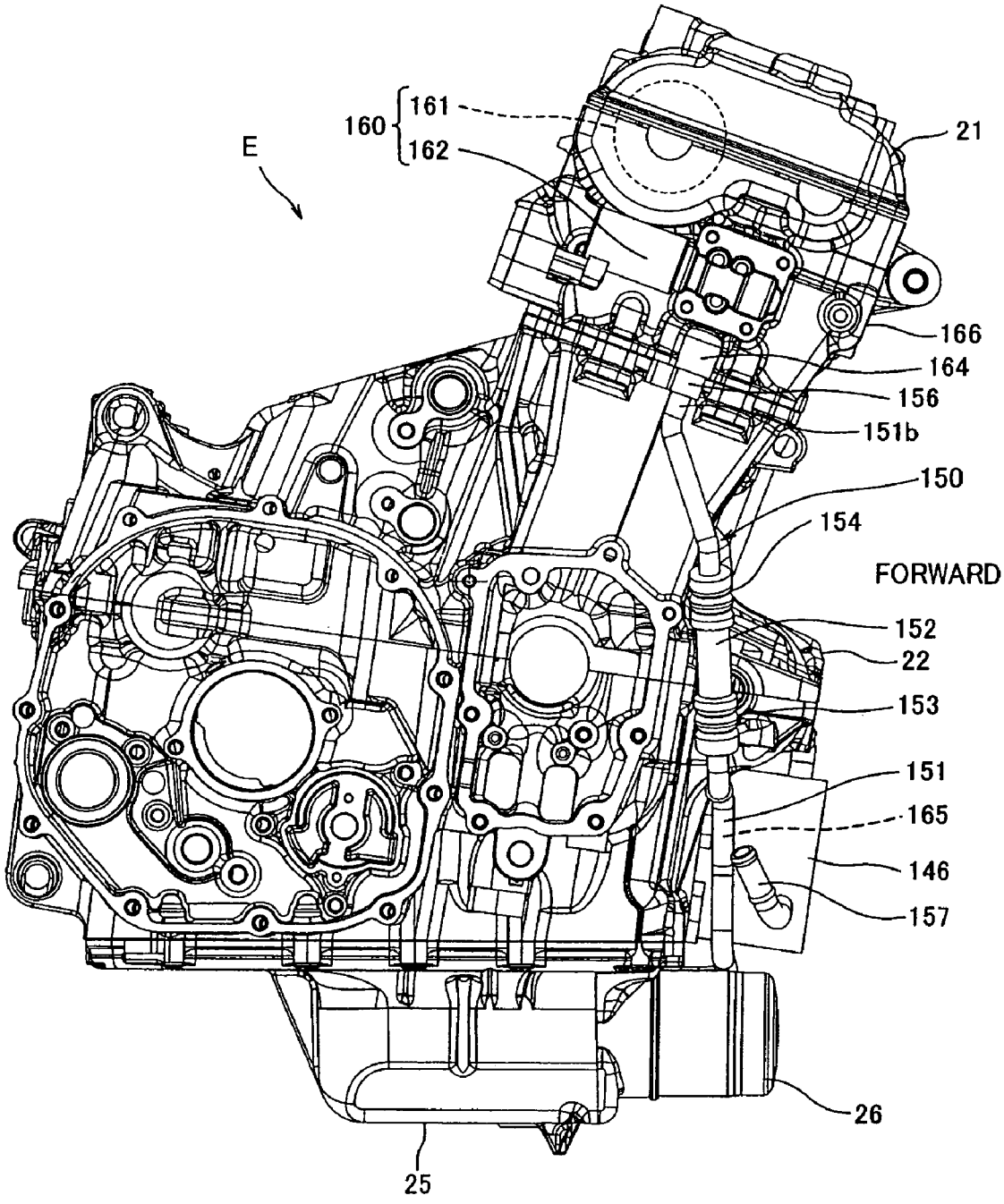
FIG. 10 is a right side view of an engine according to a second embodiment.
Figure 11:
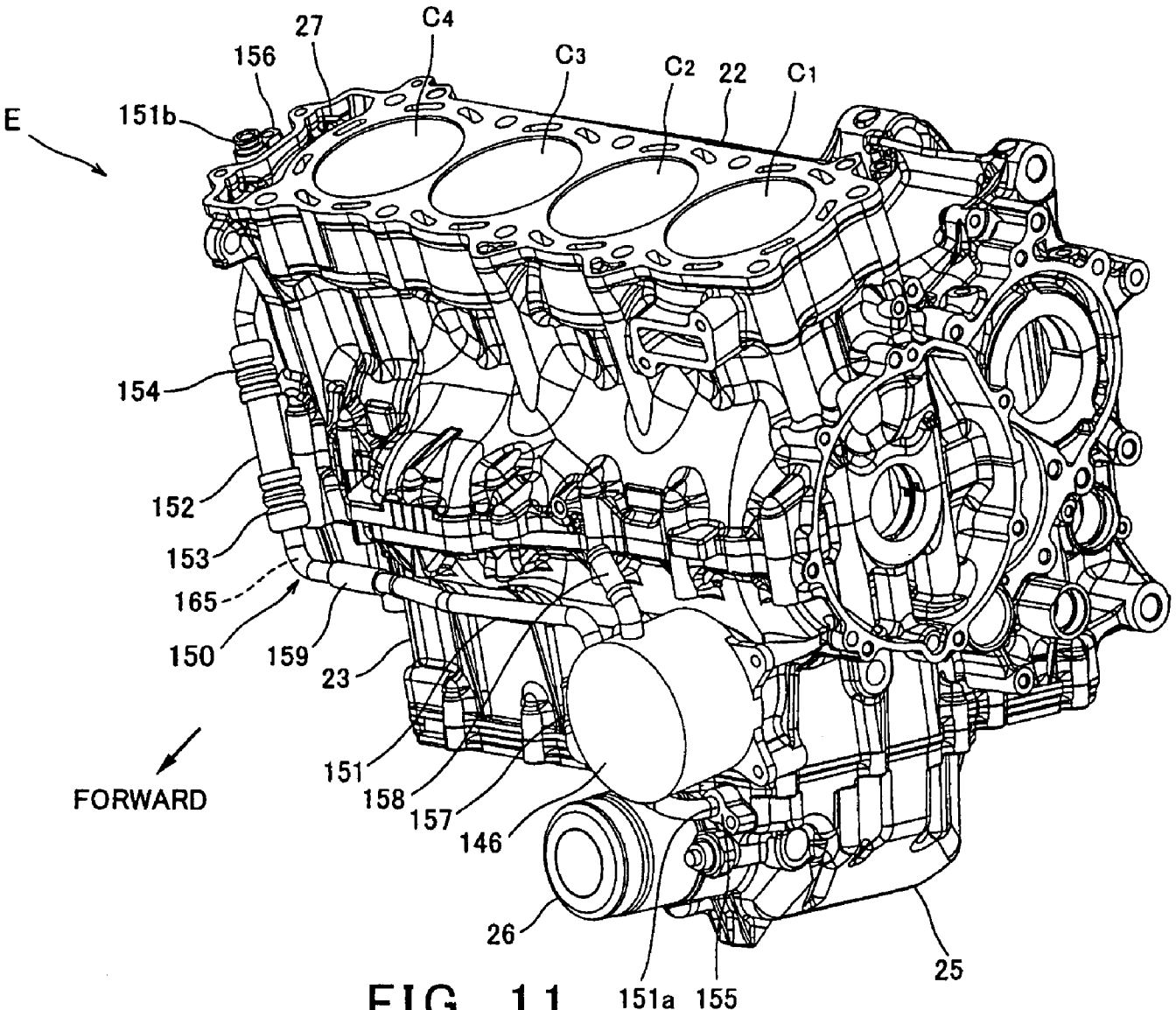
FIG. 11 is a perspective view of the engine of FIG. 10, from which the cylinder head is removed.
Figure 12:
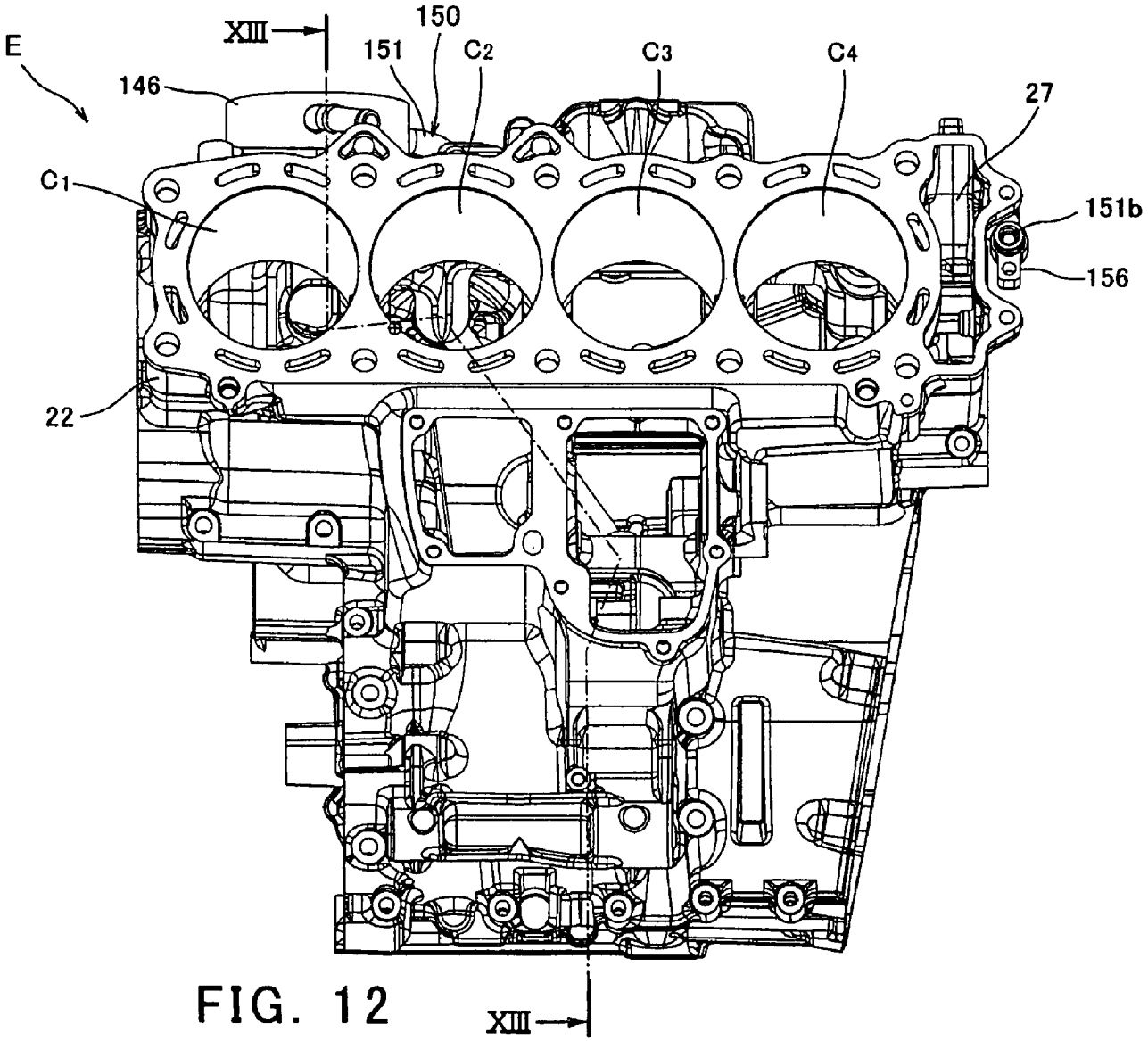
FIG. 12 is a plan view of the engine of FIG. 11.
Figure 13:
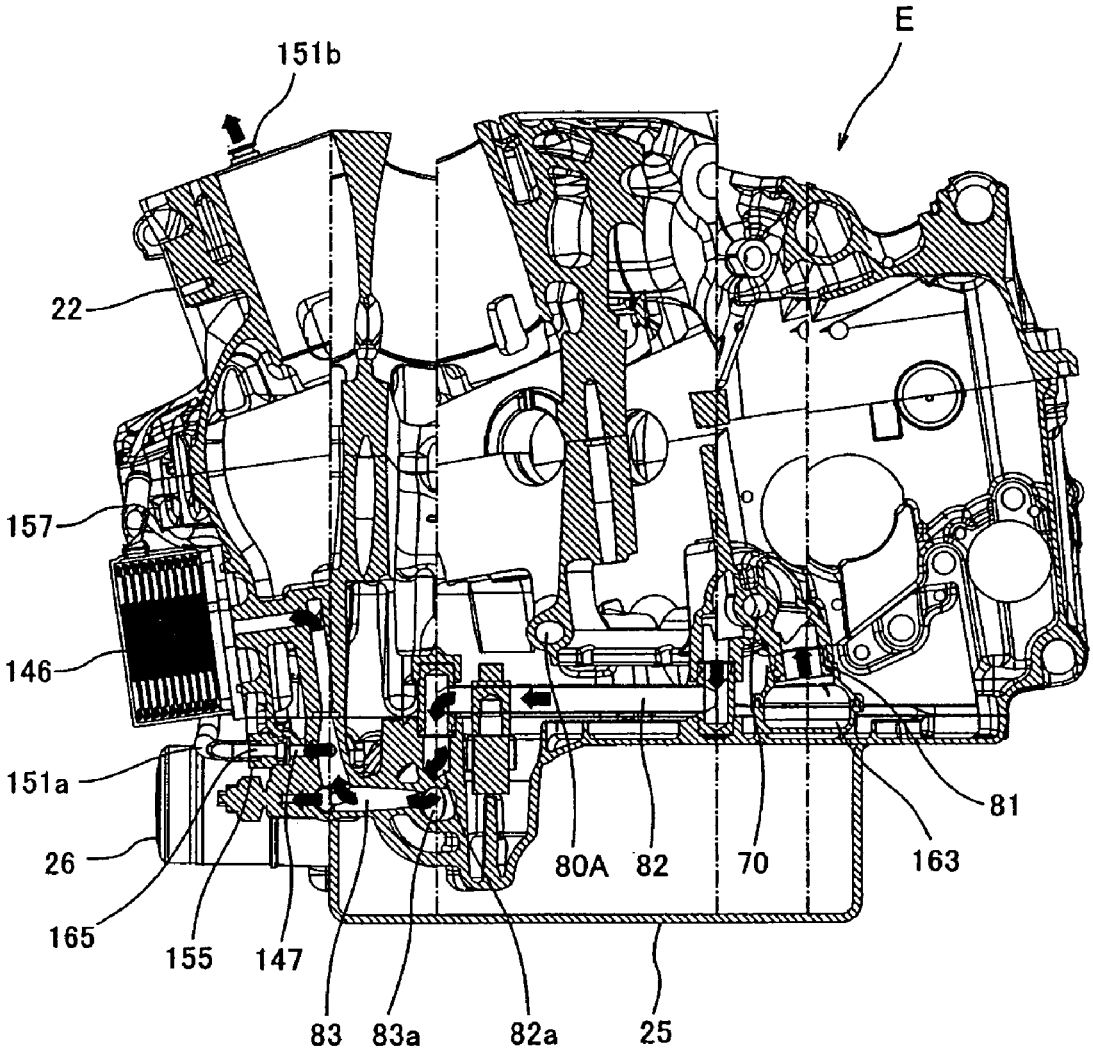
FIG. 13 is a cross-sectional view of the engine, taken substantially along line XIII-XIII of FIG. 11.
Figure 14:
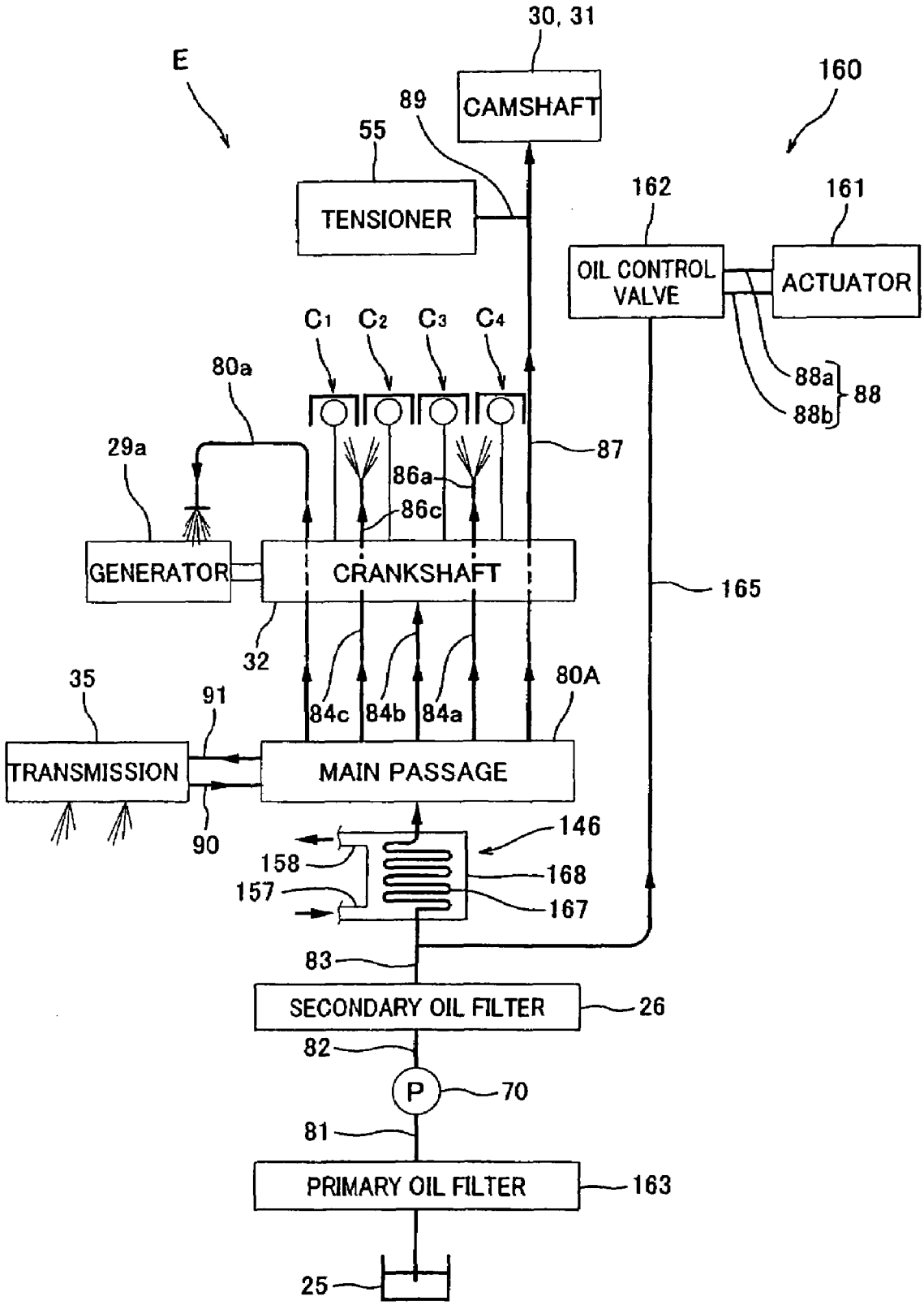
FIG. 14 is a view schematically showing a construction of oil passages of the engine of FIG. 10.

Subsequently, a second embodiment of the present invention will be described. FIG. 10 is a right side view of the engine E according to the second embodiment. FIG. 11 is a perspective view of the engine E, from which the cylinder head 20 is removed. FIG. 12 is a plan view of the engine E of FIG. 11. FIG. 13 is a cross-sectional view of the engine E, taken substantially along line XIII-XIII of FIG. 12. FIG. 14 is a view schematically showing a construction of oil passages of the engine E.

Turning now to FIGS. 13 and 14, a primary oil filter 163 is attached to a first oil passage 81 extending between the oil pan 25 that reserves the oil at the lower portion of the engine E and the oil pump 70. A second oil passage 82 is coupled to an output side of the oil pump 70 and to a secondary oil filter 26. In FIG. 13, a passage downstream of a bent portion 82*a* of the second oil passage 82, which is connected to the secondary oil filter 26, is not shown. A third oil passage 83 is coupled to an output side of the secondary oil filter 26 and to the oil cooler 146 located thereabove. In FIG. 13, a passage upstream of a bent portion 83*a* of the third oil passage 83, which is connected to the secondary oil filter 26, is not shown.

As shown in FIG. 14, the oil cooler 146 includes a sinuous oil passage 167 connected to the third oil passage 83, a housing 168 surrounding a pipe forming the sinuous oil passage 167, an inlet 157 (see FIG. 11) from which cooling water is introduced into the housing 168, and an outlet 158 (see FIG. 11) from which the cooling water is discharged from the inside of the housing 168. The cooling water flowing inside the housing 168 cools the oil flowing in the sinuous oil passage 167.

An oil passage (branched oil passage) 165 for the hydraulically-powered device branches in a location of the third oil passage 83 extending between the oil cooler 146 and the secondary oil filter 26 to feed the oil to the variable valve timing system 160. As shown in FIGS. 10 and 11, the oil passage 165 includes an oil-guiding pipe 150 externally attached along an outer surface of the engine E, more precisely, externally attached along the crankcase 23 and the cylinder block 22. The oil guiding pipe 150 extends from a left lower portion of a front surface of the engine E, upward through a right side of the oil cooler 146, rightward along the crankcase 23 in the vicinity of an upper end of the oil cooler 146, upward along a right side wall of the engine E, and to an upper end of the cylinder block 22.

The oil guiding pipe 150 includes a metal pipe 151 in large part, and an elastic pipe 152 (e.g., pressure-proof rubber pipe structured such that polyester resin is stacked on a rubber hose) that is coupled by coupling members 153 and 154 at a location where the pipe 150 is routed vertically. A rubber tube 159 is externally attached to a right portion of a portion of the metal pipe 151 extending rightward and leftward along the crankcase 23 near an upper end of the oil cooler 146 to mount a clamp member, etc. An upstream end portion 151*a* (see FIG. 13) of the oil guiding pipe 150 is coupled to a joint 155 which is bolted and fastened to an outer wall of a front surface of the engine E. In this state, a communicating passage 147 (see FIG. 13) that branches in a location of the third oil passage 83 and opens in an outer surface of the engine E communicates with the oil guiding pipe 150. Since the secondary oil filter 26 and the oil cooler 146 are externally mounted to the outer surface of the engine E and the third oil passage 83 connecting the secondary oil filter 26 to the oil cooler 146 is formed in the interior of the engine E in close proximity to the outer surface of the engine E, the communicating passage 147 formed in the interior of the engine E can be made shorter.

A downstream end portion 151*b* (see FIG. 10) of the oil guiding pipe 150 is coupled to a joint 156 which is bolted and fastened to a joint receiver 164 of a right outer wall of the cylinder head 166. The joint receiver 164 communicates with the oil control valve 162 mounted to the cylinder head 166. The oil control valve 162 is coupled to the hydraulically-powered actuator 161 through the eighth oil passage 88 (see FIG. 14) including the two sub-passages 88*a* and 88*b*. The oil control valve 162 and the hydraulically-powered actuator 161 form the hydraulically-powered variable valve timing system 160.

In the above construction, since the oil guiding pipe 150 is externally attached to the engine E as the oil passage 165 for the hydraulically-powered device, it is easily applicable to the existing engine as compared to the case where the oil passage 165 for the hydraulically-powered device is entirely contained in the interior of the engine E (crankcase 23 and cylinder block 22). Thus, the oil guiding pipe 150 can be used in a variety of engines. In addition, since it is not necessary to route the oil passage 165 for the hydraulically-powered device in the interior of the engine E, the size of the engine E itself, excluding the oil guiding pipe 150, does not increase. Furthermore, the elastic pipe 152 of the oil guiding pipe 150 can allow for dimension errors in the length between the joints 155 and 156 at both ends thereof, thus reducing a stress exerted on the metal pipe 151. The other construction is identical to that of the first embodiment, and will not be further described.

Embodiment 3

Figure 15:
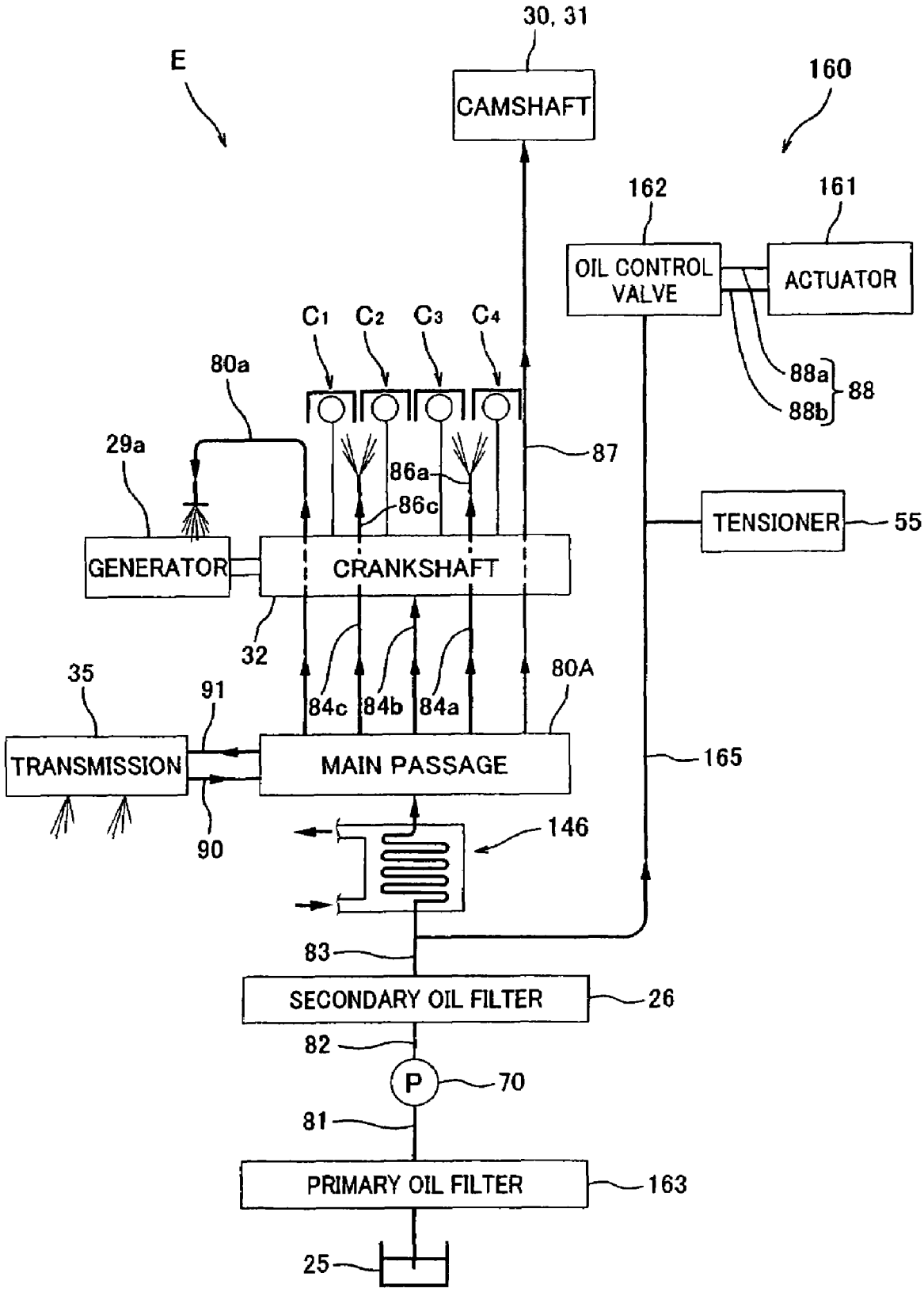
FIG. 15 is a view schematically showing a construction of oil passages of an engine according to a third embodiment.

Subsequently, a third embodiment of the present invention will be described. FIG. 15 is a view schematically showing a construction of the oil passages of the engine E according to the third embodiment. As shown in FIG. 15, in this embodiment, the oil passage 165 for the hydraulically-powered device that branches in a location of the third oil passage 83 extending between the oil cooler 146 and the secondary oil filter 26 further branches to feed the oil to the hydraulically-powered tensioner 55.

In the above construction, since the oil pressure without the pressure loss that may be caused by the oil cooler 146 is fed to the hydraulically-powered tensioner 55, the tensioner 55 is able to efficiently apply a forward force to the chain guide 51 (see FIG. 2), thereby applying a suitable tension to the timing chain 50. The other construction is identical to that of the first embodiment, and will not be further described.

Embodiment 4

Figure 16:
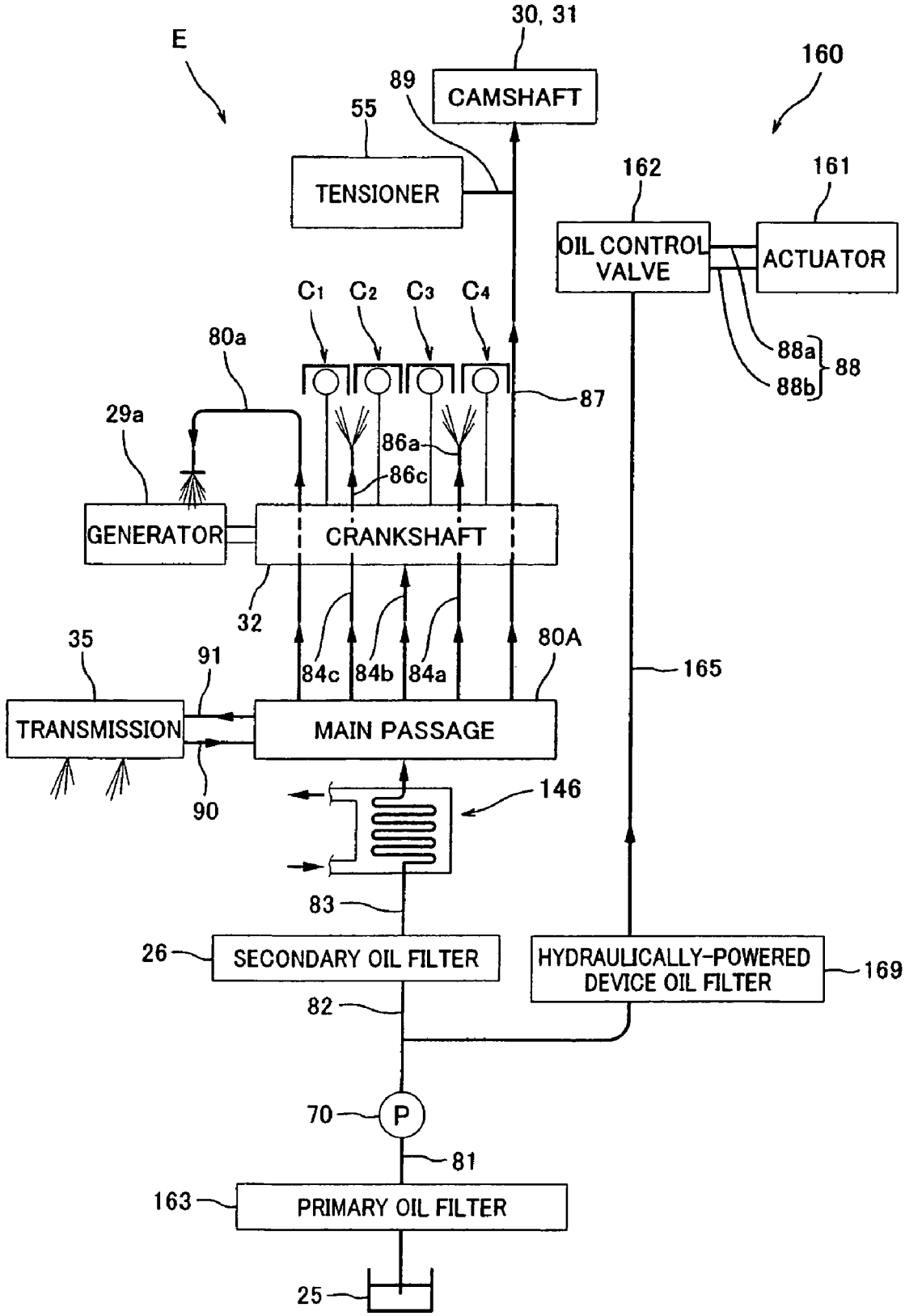
FIG. 16 is a view schematically showing a construction of oil passages of an engine according to a fourth embodiment.

Subsequently, a fourth embodiment of the present invention will be described. FIG. 16 is a view schematically showing a construction of the oil passages of the engine E according to the fourth embodiment. As shown in FIG. 16, in this embodiment, the oil passage 165 for the hydraulically-powered device branches in a location of the second oil passage 82 located upstream of the oil cooler 146 and the secondary oil filter 26. An oil filter 169 for the hydraulically-powered device that has filtering resistance lower than that of the secondary oil filter 26 is mounted to a location of the oil passage 165.

With the above construction, the pressure loss of the oil delivered from the oil pump 70 to the oil control valve 162 of the variable valve timing system 160 can be minimized. The other construction is identical to that of the first embodiment, and will not be further described.

Subsequently, an example of the present invention will be compared to a comparison.

EXAMPLE

In the example, using the second embodiment described with reference to FIGS. 10 to 14, the oil pressure of the oil flowing in the branched oil passage 165 for the hydraulically-powered device was measured to find the oil pressure of the oil delivered to the variable valve timing system 160.

Comparison

In the comparison, the branched oil passage 165 for the hydraulically-powered device was branched not in a location upstream of the oil cooler 146 but in a location downstream of the oil cooler 146 to deliver the oil to the variable valve timing system 160. The oil pressure of the main passage 80A was measured to find the oil pressure of the oil delivered to the variable valve timing system 160. The other conditions are the same as those of the example.

Experiment and Analysis

Figure 17:
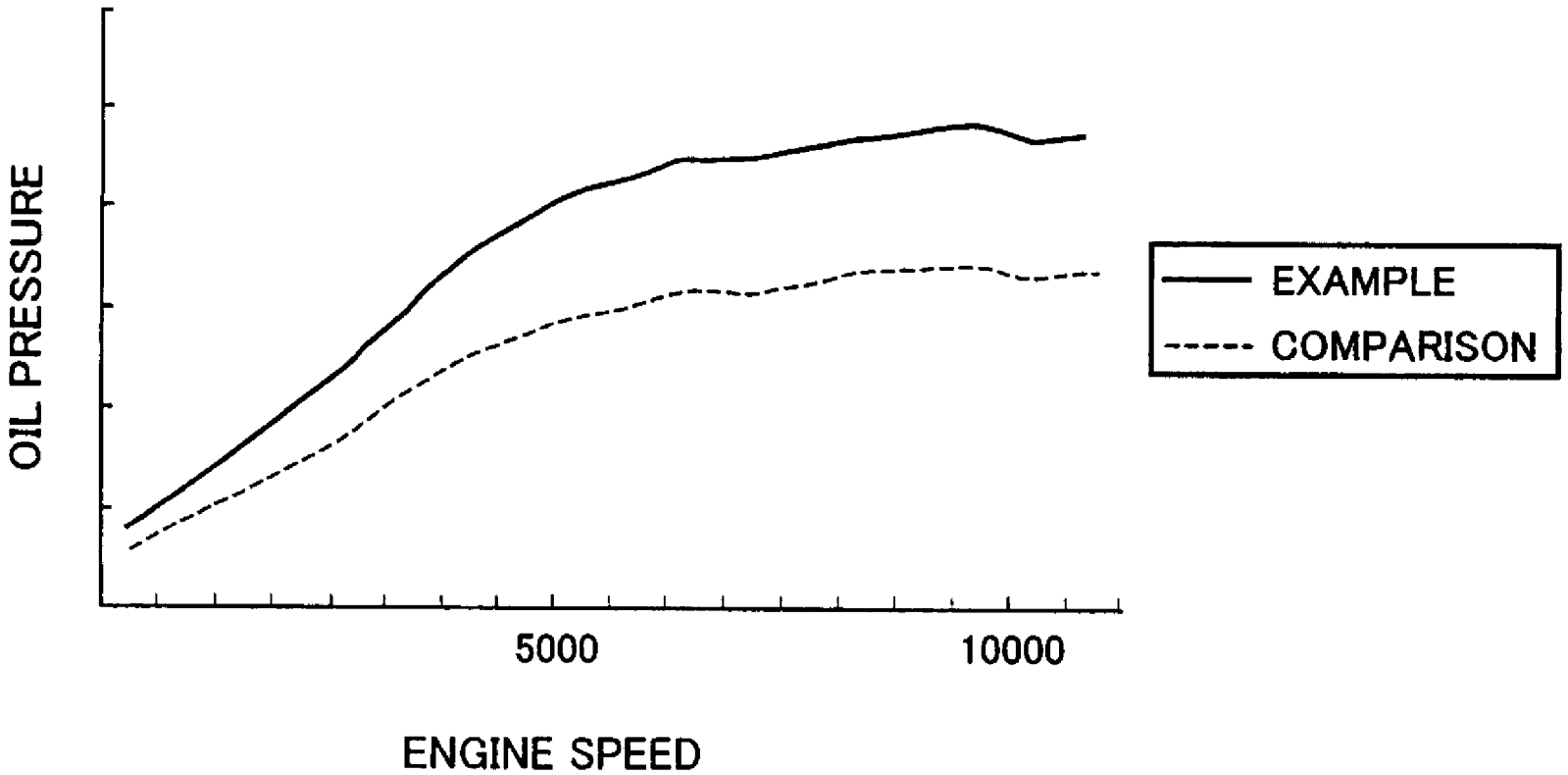
FIG. 17 is a graph showing measurement results of an oil pressure of oil delivered to a variable valve timing system, which changes according to an engine speed in an example and a comparison.

FIG. 17 is a graph showing measurement results of the oil pressure of the oil delivered to the hydraulically-powered variable valve timing system 160, which changes according to an engine speed in the example and the comparison. As can be seen from FIG. 17, in the example in which the oil passage 165 is branched in a location upstream of the oil cooler 146, the oil pressure was increased in approximately 30% to 40% as compared to the comparison in which the oil passage 165 is branched in a location downstream of the oil cooler 146. Because of the 30% to 40% increase in the oil pressure, the amount of the oil output from the oil pump 70 can be reduced by approximately 30%, making it possible to reduce the width of a rotor of the oil pump 70. As a result, mechanical energy loss can be reduced during the operation of the oil pump 70.

Whereas the inline four-cylinder engine has been described in the above embodiments, the oil feeding system of the present invention is applicable to a two-cylinder engine, a three-cylinder engine, an inline engine, a horizontally-opposed engine, or a V-type engine. Furthermore, whereas in the above embodiments, the engine integral with the transmission has been illustrated, the oil feeding system of the present invention is applicable to an engine from which the transmission is separable or an engine which is not equipped with a transmission. Moreover, the oil feeding system of the present invention is applicable to engines of leisure vehicles other than the motorcycle, such as an all terrain vehicle (ATV), or a personal watercraft (PWC).

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An engine comprising:

an oil pump;

a first oil filter;

an oil cooler;

a first oil passage through which oil output from the oil pump flows to the first oil filter;

a second oil passage through which oil output from the first oil filter flows to the oil cooler;

a branched oil passage for a hydraulically-powered device of the engine that is configured to branch in a location of the first oil passage located upstream of the oil cooler and the first oil filter to deliver the oil to the hydraulically-powered device; and a second oil filter for the hydraulically-powered device that has filtering resistance lower than that of the first oil filter and is mounted to a location of the branched oil passage.

2. The engine according to claim 1, wherein the hydraulically-powered device is a hydraulically-powered variable valve timing system configured to change a phase angle of a camshaft with respect to a crankshaft and/or a hydraulically-powered tensioner configured to apply a force to a chain guide that guides a chain through which the crankshaft is cooperatively coupled to the camshaft.

3. An engine comprising:

an oil passage through which oil output from an oil pump flows;

an oil cooler mounted to the oil passage; and a branched oil passage for a hydraulically-powered device of the engine that is configured to branch in a location of the oil passage extending from the oil pump to the oil cooler to deliver the oil to the hydraulically-powered device;

wherein at least a part of the branched oil passage for the hydraulically-powered device includes an oil guiding pipe extending outside of the engine.

4. The engine according to claim 3, wherein the oil guiding pipe protrudes from an outer wall of a lower portion of the engine and is guided to the hydraulically-powered device located at an upper region of the engine.

5. The engine according to claim 4, wherein the oil guiding pipe is removably attached to the engine by joints provided at both ends thereof.

6. The engine according to claim 5, wherein the oil guiding pipe includes a metal pipe and an elastic pipe which are coupled to each other.

* * * * *